US011215048B2

(12) United States Patent
Petrella et al.

(10) Patent No.: US 11,215,048 B2
(45) Date of Patent: Jan. 4, 2022

(54) SYSTEM AND METHOD FOR MONITORING AND CONTROLLING FLUID FLOW

(71) Applicant: KOBOLD CORPORATION, Calgary (CA)

(72) Inventors: Allan Petrella, Calgary (CA); Matthew Brown, Calgary (CA); Per Angman, Calgary (CA); Mark Andreychuk, Calgary (CA)

(73) Assignee: KOBOLD CORPORATION, Calgary (CA)

( * ) Notice: Subject to any disclaimer, the term of this patent is extended or adjusted under 35 U.S.C. 154(b) by 53 days.

(21) Appl. No.: 16/735,552

(22) Filed: Jan. 6, 2020

(65) Prior Publication Data

US 2020/0217189 A1 Jul. 9, 2020

Related U.S. Application Data

(60) Provisional application No. 62/788,289, filed on Jan. 4, 2019.

(51) Int. Cl.

| | |
|---|---|
| ***E21B 47/10*** | (2012.01) |
| ***E21B 43/16*** | (2006.01) |
| ***E21B 34/06*** | (2006.01) |
| *E21B 33/12* | (2006.01) |
| *E21B 43/14* | (2006.01) |

(52) U.S. Cl.

CPC ..... *E21B 47/10* (2013.01); *E21B 34/06* (2013.01); *E21B 43/16* (2013.01); *E21B 33/12* (2013.01); *E21B 43/14* (2013.01)

(58) Field of Classification Search

CPC ..... E21B 47/10; E21B 47/103; E21B 47/107; E21B 47/11; E21B 47/111; E21B 43/16; E21B 34/06; E21B 33/12; E21B 43/14; E21B 43/20; E21B 43/12

See application file for complete search history.

(56) References Cited

U.S. PATENT DOCUMENTS

| | | | | |
|---|---|---|---|---|
| 4,482,806 A * | 11/1984 | Wagner, Jr. | ..... | E21B 47/11 250/260 |
| 5,044,436 A * | 9/1991 | Magnani | ..... | E21B 47/11 166/247 |
| 6,840,316 B2 * | 1/2005 | Stegemeier | ..... | E21B 47/11 166/250.12 |

(Continued)

*Primary Examiner* — Brad Harcourt

(74) *Attorney, Agent, or Firm* — Parlee McLaws LLP; Chi Fai Andrew Lau

(57) ABSTRACT

A flow monitoring system can have a plurality of sensors located at monitoring locations along a tubing string inserted into an injector well of a secondary recovery operation. The sensors are configured to monitor a measurable property of fluids flowing in a bore of the tubing string or in an annulus formed between the tubing string and injector bore to determine the presence of said injected fluids at each sensor. At least two fluids having different values of the measurable property are injected into the injector well in an alternating manner and at a known injection rate. The flow rates of the fluids out of various injection zones of the injection well can be calculated using the arrival times and the known injection flow rates of the fluids, cross-sectional area of the fluid conduit(s) through which the fluids travel, and distances between the sensors or between surface and the sensors.

19 Claims, 21 Drawing Sheets

(56) References Cited

U.S. PATENT DOCUMENTS

| | | | | |
|---|---|---|---|---|
| 2015/0134253 | A1* | 5/2015 | Ring | E21B 47/11 702/6 |
| 2016/0047232 | A1* | 2/2016 | Palomarez | E21B 21/062 166/250.12 |
| 2020/0123896 | A1* | 4/2020 | Smithson | G01F 1/74 |

* cited by examiner

Arrival time differences, combined with knowledge of volumes between each sub used to calculate fluid rate.

| Date | Units 13&12a | | | Units 12a&12b | | | Units 12b&12c | | | Units 12c&12d | | |
|---|---|---|---|---|---|---|---|---|---|---|---|---|
| | Time | Rate | % | Time | Rate | % | Time | Rate | % | Time | Rate | % |
| July/15 | 02:24:20 | 17.60 | 100.0 | 00:38:02 | 16.39 | 93.1 | 00:45:35 | 15.79 | 89.7 | 01:01:49 | 14.13 | 80.3 |
| July/16 | 02:34:40 | 16.43 | 100.0 | 00:45:19 | 13.75 | 83.7 | 01:02:27 | 11.53 | 70.2 | | | |
| July/17 | 02:26:04 | 17.39 | 100.0 | 00:47:16 | 13.19 | 75.8 | 01:07:26 | 10.68 | 61.4 | | | |
| July/18 | 02:23:30 | 17.71 | 100.0 | 00:45:21 | 13.74 | 77.6 | 01:03:00 | 11.43 | 64.5 | | | |
| July/19 | 02:19:31 | 18.21 | 100.0 | 00:43:13 | 14.42 | 79.2 | 01:00:52 | 11.83 | 64.9 | | | |
| July/20 | 02:22:31 | 17.83 | 100.0 | 00:44:13 | 14.10 | 79.1 | 01:03:36 | 11.32 | 63.5 | | | |
| July/21 | 02:11:03 | 19.39 | 100.0 | 00:39:35 | 15.75 | 81.2 | 00:57:27 | 12.53 | 64.6 | | | |
| July/22 | 02:14:43 | 18.86 | 100.0 | 00:41:27 | 15.04 | 79.7 | 01:02:32 | 11.51 | 61.0 | | | |
| July/23 | 02:16:13 | 18.65 | 100.0 | 00:44:01 | 14.16 | 75.9 | 01:07:31 | 10.66 | 57.2 | | | |
| July/24 | 02:00:49 | 21.03 | 100.0 | 00:36:50 | 16.92 | 80.5 | 00:53:25 | 13.48 | 64.1 | | | |
| July/25 | 02:07:57 | 19.86 | 100.0 | 00:37:03 | 16.82 | 84.7 | 00:50:45 | 14.19 | 71.4 | | | |
| July/26 | 01:59:05 | 21.34 | 100.0 | 00:37:47 | 16.50 | 77.3 | 00:54:58 | 13.10 | 61.4 | | | |
| Average | | 18.69 | 100.0 | | 15.06 | 80.7 | | 12.34 | 66.2 | | | |

*Fig. 6A*

SYSTEM AND METHOD FOR MONITORING AND CONTROLLING FLUID FLOW

CROSS-REFERENCE TO RELATED APPLICATIONS

This application claims the benefit of U.S. Provisional Patent application Ser. No. 62/788,289, filed Jan. 4, 2019, the entirety of which is incorporated herein by reference.

FIELD

Embodiments herein relate to the recovery of oil from hydrocarbon reservoirs by fluid flooding. In particular, embodiments herein relate to an improved system and method of monitoring fluid flow in fluid flooding operations for enhanced hydrocarbon recovery operations.

BACKGROUND

Only a portion of the hydrocarbons contained in a hydrocarbon reservoir can be produced by primary recovery methods, such as by allowing the hydrocarbons to be produced to surface via the pressures initially present in the reservoir or with pump jacks and other artificial lift devices. When hydrocarbon production has slowed or is no longer economical using primary recovery methods, it is common for producers to employ enhanced or secondary recovery methods, such as fluid flooding, to further extract additional hydrocarbons from the reservoir.

Fluid flooding involves injecting a liquid or gas, such as water or $CO_2$, into one or more injector wells near one or more producer wells from which hydrocarbons are to be produced. The fluid exits the injector well into the reservoir through injection zones located at about the strata of the hydrocarbon reservoir from which hydrocarbons are to be extracted. The injection zones can be portions of the well having perforations in the well casing, or some other means of permitting fluid communication between the wellbore and the reservoir. Fluid introduced into the hydrocarbon reservoir displaces hydrocarbons therein towards the producer well, thereby permitting more hydrocarbons to be produced therefrom than with primary recovery methods alone.

During fluid flooding operations, it is desirable to have a uniform flood front emanating from the injector well towards the producer well, such that hydrocarbons are displaced generally evenly towards to the producer well, and the flood front is about parallel with the injector and producer wells. An uneven flood front can result in the premature breakthrough of fluid at the producer well, channeling of water around hydrocarbon-bearing zones of the reservoir, or other undesirable effects. Due to the heterogenous composition and structure of hydrocarbon reservoirs, it is difficult to achieve a uniform flood front, as the injected fluid tends to flow through areas of the reservoir having higher permeability as it migrates towards the production well. Measurements can be taken to determine the flow of fluid at the various injection zones of the injector well. In some fluid flood operations, adjustments can be made at the injector well to produce a more uniform flood front in response to flow measurements, such as by plugging, closing, or otherwise blocking the injection zones of the injector well which deliver an excessive amount of water therethrough. However, determining the flow rate of fluid through the various injection zones of the injector well can be challenging. Further, the adjustment of the fluid flow rate through the injection zones can be cumbersome and time-consuming, potentially requiring the withdrawal of wellbore tubing from the injector well, and the actuation of downhole flow control devices of the injector well using mechanical actuation tools run into the well. Moreover, the successful actuation of the flow control devices to achieve the desired flow rates may be difficult to confirm, especially in cases where the flow control devices can be adjusted by degrees as opposed to simple open-close binary operation.

Distributed temperature sensing (DTS) systems are known to have been implemented along injector or producer wells to detect temperature differentials indicative of the arrival of an injected fluid at the plurality of injection zones. However, by the time fluid reaches the depth of the reservoir, it is generally substantially at ambient temperature, rendering the detection of temperature differentials difficult and ineffective for determining the arrival of injected fluid.

It is also known to position flow meters, commonly known as "spinners", adjacent to the injection zones of the injector well. The spinners comprise rotors configured to be driven by fluid flowing out of the injector wells and generate an electrical signal proportional to the rate of rotation caused by the flow rate of fluid thereby. However, such devices lose effectiveness in low-permeability reservoirs where high rates of fluid flow are not practical.

Another known method of measuring fluid flow is to isolate the injection zones of the injector well and test fluid flow therethrough individually by mixing a tracer into the injected fluid and measuring the volume of tracer-containing fluid produced from the producer well. However, such methods may not be indicative of the fluid flowing actually through a perforated zone during normal fluid injection operations, as isolating the injection zones can potentially change the local processes and stresses in the wellbores and reservoir, and thus change the flow behaviour. Additionally, it can take weeks for the tracer-containing fluid to reach the producer well, and therefore such a method is time consuming and delays the ability of an operator to react to flow conditions in the wellbore.

There is a need for a system and method of obtaining information regarding fluid flow through the injection zones of an injector well in a reliable, efficient, and timely manner that can be used to determine fluid flow at the plurality of injection points along a wellbore, and particularly in reservoirs of varying permeability. Additionally, there is a need for a system and method to adjust fluid flow in response to the acquired fluid flow information.

SUMMARY

A system and method are provided herein for acquiring data regarding fluid flow through various injection zones of an injector well in a fluid flood secondary hydrocarbon recovery operation and, in some embodiments, for adjusting the fluid flow through one or more of the injection zones.

The system comprises a plurality of sensors located along a tubing string inserted into the injector well. Each injection zone has at least one sensor positioned upstream thereof, and the sensors are configured to monitor a measureable property of fluids flowing thereby. A pump system is configured to alternatingly pump at least a first and second fluid into the injector well. The first and second fluids possess first and second values of the measurable property, the first value being different from the second value.

An abrupt change in the value of the measurable property monitored by the sensors indicates that the fluid flowing thereby has from the first fluid to the second fluid or vice versa. The times at which such changes in the measurable property are detected can be logged as arrival times for the first and second fluids. The flow rate of fluid through each of the injection zones can be calculated by using the arrival times and the known injection flow rates of the first and second fluids, cross-sectional area of the fluid conduit(s) through which the fluids travel, and distances between the various sensors and/or between surface and the sensors.

In a broad aspect, a method of monitoring and adjusting fluid flow from a wellbore out of a plurality of injection zones of the wellbore, comprises: alternatingly injecting at least a first fluid and a second fluid into the wellbore at an injection flow rate, the first fluid having a first value of a measurable property and the second fluid having a second value of the measurable property different from the first value; monitoring the measurable property at an initialization location and a plurality of monitoring locations; recording an initialization time at which the measurable property changes significantly at the initialization location; recording an arrival time at which the measurable property changes significantly at each of the monitoring locations; and determining a flow rate of fluid out of one or more of the plurality of injection zones.

In an embodiment, the step of recording the initialization time comprises recording the time at which the measurable property changes from about the first value to about the second value, or from about the second value to about the first value at the initialization location; and the step of recording the arrival time comprises recording the time at which the measurable property changes from about the first value to about the second value, or from about the second value to about the first value, at each of the monitoring locations.

In an embodiment, the step of determining the flow rate of fluid comprises calculating the flow rate of fluid using a cross-sectional area of a flow conduit through which the first and second fluids flow, the initialization time, the arrival times, distances from the initialization location to the monitoring locations, and the injection flow rate.

In an embodiment, the method further comprises actuating one or more flow control devices each corresponding to a respective one of the plurality of injection zones in response to the determined flow rate of fluid out of one or more of the plurality of injection zones.

In an embodiment, the steps of monitoring the measurable property, recording the initialization time, recording the arrival times, and determining the flow rate are performed substantially in real-time.

In an embodiment, the steps of monitoring the measurable property, recording the initialization time, recording the arrival times, determining the flow rate, and actuating the one or more flow control devices are performed substantially in real-time.

In an embodiment, the first and second fluids are injected into the wellbore via a tubing string extending into the wellbore.

In an embodiment, the first and second fluids are injected into the wellbore via an annulus formed between a tubing string extending into the wellbore and the casing.

In an embodiment, the method further comprises fluidly isolating each of the injection zones.

In an embodiment, isolating each of the injection zones comprises deploying a plurality of packers in an annulus formed between the tubing string and the casing.

In another broad aspect, a method of monitoring and adjusting fluid flow from a wellbore out of a plurality of injection zones of the wellbore comprises: installing a plurality of sensors on a tubing string, each of the plurality of sensors configured to monitor a measurable property of at least a first fluid and a second fluid; and inserting the tubing string into the wellbore to position the plurality of sensors adjacent to a corresponding one of the plurality of injection zones.

In an embodiment, the step of inserting the tubing string into the wellbore comprises positioning the plurality of sensors such that each of the plurality of sensors is located upstream of a corresponding one of the plurality of injection zones.

In an embodiment, the step of inserting the tubing string into the wellbore comprises positioning the plurality of sensors such that each sensor of the plurality of sensors is located upstream of a respective injection zone of the plurality of injection zones.

In an embodiment, the method further comprises installing an initializing sensor on the tubing string, the initializing sensor configured to monitor the measurable property upstream of the plurality of sensors.

In an embodiment, the method further comprises installing a plurality of packers on the tubing string, and wherein the step of inserting the tubing string into the wellbore further comprises positioning the plurality of packers such that each of the plurality of injection zones is straddled by two packers of the plurality of packers.

In an embodiment, the method further comprises installing a plurality of flow control devices on the tubing string, and the step of inserting the tubing string into the wellbore further comprises positioning the plurality of flow control devices such that each of the plurality of flow control devices is located adjacent a corresponding one of the plurality of injection zones.

In another broad aspect, a system for monitoring and adjusting fluid flow from a wellbore out of a plurality of injection zones of the wellbore comprises: a fluid pump configured to alternatingly pump a first fluid and a second fluid into the wellbore at a flow rate; a plurality of sensors spaced along a tubing string, each of the plurality of sensors located adjacent to a corresponding one of the plurality of injection zones and configured to monitor a measurable property of at least a first fluid and a second fluid; wherein the first fluid has a first value of the measurable property and the second fluid has a second value of the measurable property different from the first value; and wherein distances between each sensor of the plurality of sensors are known.

In an embodiment, each of the plurality of sensors is located immediately uphole of the corresponding one of the plurality of injection zones.

In an embodiment, the system further comprises an initializing sensor positioned upstream of the plurality of sensors, wherein at least a distance between the initializing sensor and a sensor of the plurality of sensors immediately downstream of the initializing sensor is known.

In an embodiment, the system further comprises a plurality of packers positioned along the tubing string such each of the plurality of injection zones is straddled by two packers of the plurality of packers.

In an embodiment, the plurality of packers is operatively connected to a controller at surface via a wireline.

In an embodiment, the system further comprises a plurality of flow control devices positioned along the tubing string and located adjacent a corresponding one of the plurality of injection zones, each of the flow control devices being actuable between at least a fully open position and a fully closed position.

BRIEF DESCRIPTION OF THE DRAWINGS

FIG. 6A represents tabulated resistivity data acquired by the system of FIG. 2B;

DESCRIPTION

Figure 1:
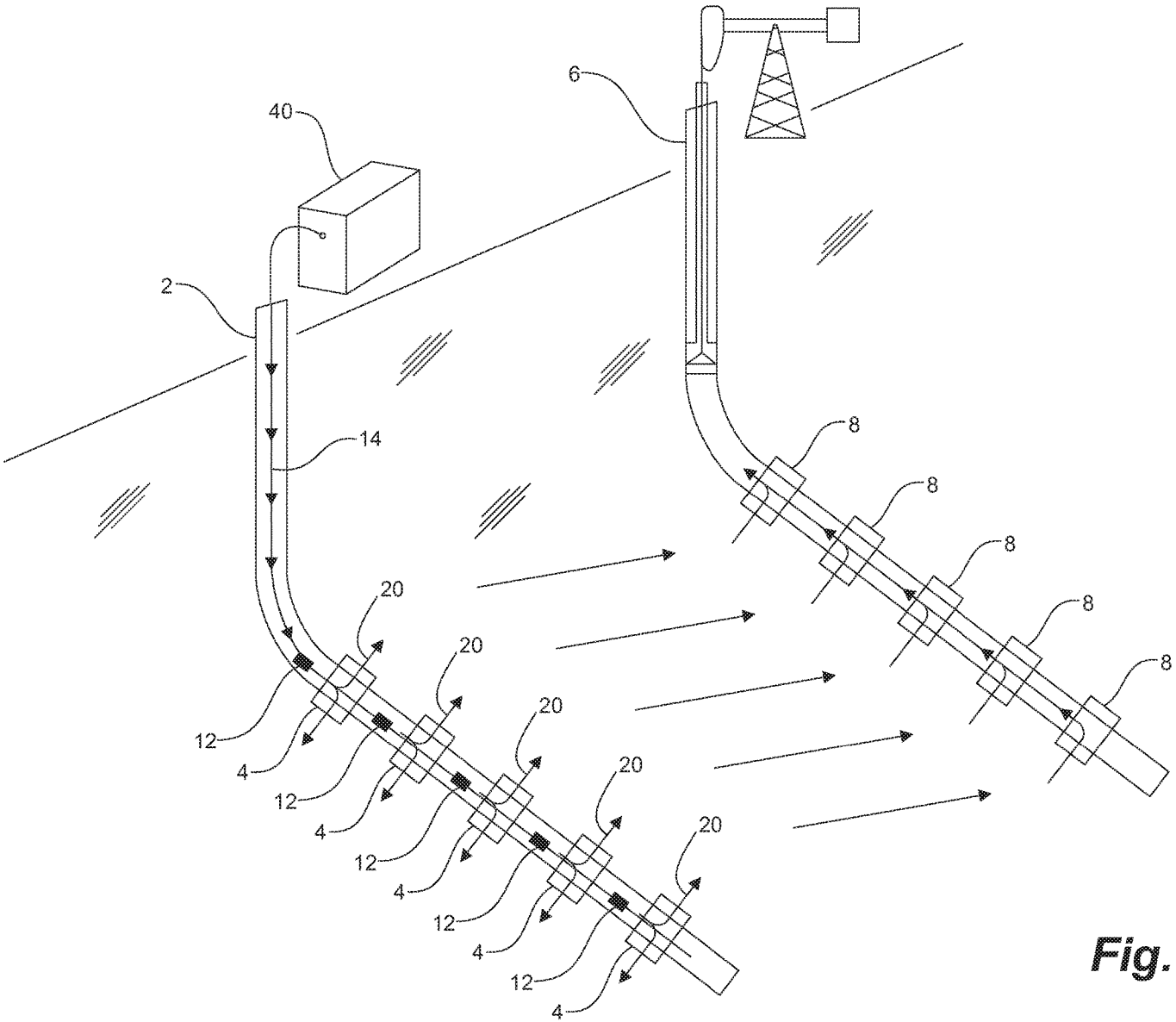
FIG. 1 is a schematic representation of an embodiment of a fluid flooding system comprising an injection and production well and a fluid flow monitoring system located within the injector well.

A system and method are provided herein for acquiring data regarding fluid flow through various injection zones 4 of an injector well 2 in a fluid flood secondary hydrocarbon recovery operation and, in some embodiments, for adjusting the fluid flow through one or more of the injection zones 4.

Herein, "injection zones" refer to areas of the injector well having means for permitting fluid to flow from the injector well into the surrounding hydrocarbon formation, such as perforations, openings, ports, valves, and the like. In embodiments, the injection zones can further comprise sleeves or other devices that can be actuated to selectively establish or prevent fluid communication between the wellbore and the formation, or control the rate of fluid flow therethrough.

Herein, references to "fluid" herein include both liquid and gas, such as water and $CO_2$. References to a wellbore "tubing string" herein include, but are not limited to, coiled tubing, jointed tubing, and the like.

General System

Embodiments of the flow monitoring system 10 comprise a plurality of sensors 12 installed at monitoring locations along a tubing string 14 located inside an injector well 2. The sensors 12 are configured to monitor the fluids flowing in a bore 16 of the tubing string 14, or in an annulus 18 formed between the tubing string 14 and injector bore 2, for a measurable property characteristic of the initial presence of said injected fluids at each sensor 14, or a change in the character thereof.

At least two injection fluids 20 can be injected into the injector well 2 in an alternating manner and at a known injection rate. The first injection fluid 20*a* possesses a first value of the measurable property, and the second injection fluid 20*b* has a second value of the measurable property that is different from the first value. For example, the first fluid 20*a* can be saline water having a low electrical resistivity, and the second fluid 20*b* can be clean water having a relatively higher resistivity. Other fluids or additives can be used to provide the first and second fluids 20*a*,20*b* with their respective first and second values of the measurable property. For example, a tracer can be added to the first fluid 20*a* that is not added to the second fluid 20*b*. Such use of tracers and sensors 12 configured to detect said tracers in the injector well 2 provides a more immediate indication of fluid flow behavior when compared to the conventional mixing of a tracer into the injected fluid and measuring the volume of tracer-containing fluid produced from the producer well, as the flow rates of fluid out of each injection zone 4 can be calculated using measurements obtained by the sensors 12 located in the injector well 2 as opposed to waiting for the injected fluid to reach the producer ell and be produced to surface.

Without intent to limit the fluids, measurable property, or additives that may be used, embodiments described herein relate to the context of water injection with electrical resistivity as the measurable property, and wherein the additive is salt or the absence thereof. The level of salt in a fluid is inversely proportional to the resistivity thereof.

The arrival times of the fluids 20*a*,20*b* at each sensor 12, signified by the time at which the measurable property detected by the sensor 12 changes suddenly and significantly, are recorded. An initialization sensor 13, also configured to monitor the measurable property, can be located at an initialization location uphole of the rest of the sensors 12 and be used to record an initialization time when the first or second fluid 20*a*,20*b* arrives thereat. The flow rate, initialization time and arrival times of the fluid flow at each of the sensors 12,13 are used in conjunction with the known injection rate of the fluids 20*a*,20*b*, known dimensions of the tubing string 14, annulus 18, and other conduits of the wellbore through which the fluids 20*a*,20*b* travel to reach the injection zones 4 of the injector well 2, and known distances between the sensors 12,13, to calculate the rates of fluid flow out of the well via the various injection zones 4. In embodiments, each injection zone 4 has a respective sensor 12 located upstream thereof.

More specifically, the fluid flow rate at each of the sensors 12 can be calculated and compared to determine the flow rate out of the injection zones 4 located between pairs of sensors 12. The difference in flow rate between two sensors 12 is the flow rate of fluid exiting the injection well 2 via the injection zones 4 therebetween.

If the injection rate of fluids into the injector well 2 is not known, at least two sensors 12 can be located upstream of the injection zones 4 and spaced from one another such that the initial flow rate can be calculated. For example, the initialization sensor 13 and a sensor 12*a* located upstream of the first injection zone 4*a* can be used to detect and log the arrival times of the fluids 20*a*,20*b*, and the flow rate along the bore 16 can be calculated using the arrival times, the distance between the sensors 12*a*,13, and the cross-sectional flow area of the flow conduit—i.e. the tubing string bore 16 or annulus 18—between the sensors 12,13*a*.

The flow monitoring system 10 can be implemented together with a flow control system 60 configured to adjust the fluid flow through each of the injection zones 4, thereby permitting the flow of fluid from the injector well 2 through the hydrocarbon formation into the producer well 6 to be tuned to provide the desired flow characteristics.

Calculation of Flow Rates

Figure 2A:
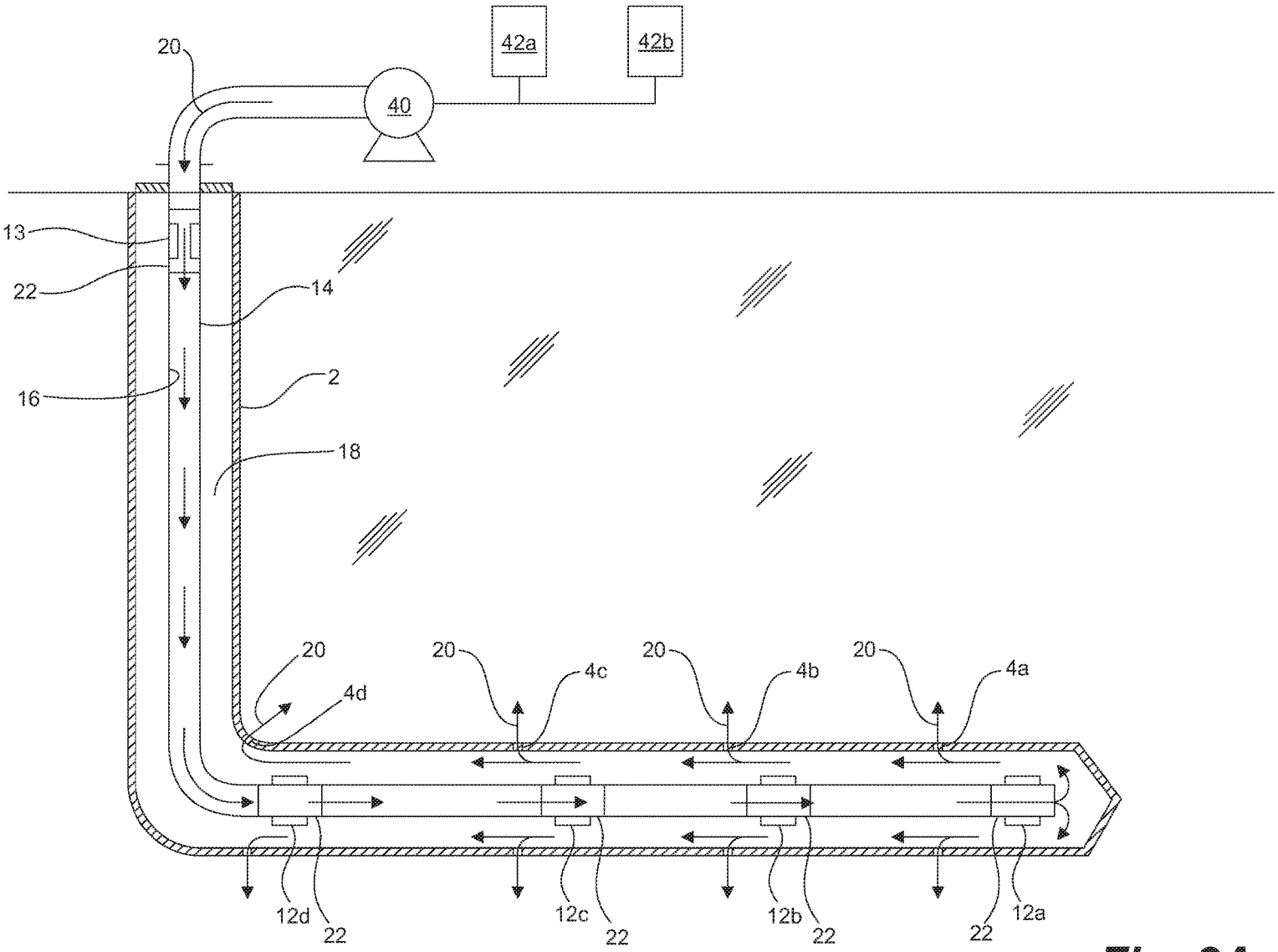
FIG. 2A is a schematic representation of another embodiment of a fluid flow monitoring system disclosed herein having five resistivity flow monitors for measuring resistivity of fluid flowing thereby, and wherein first and second fluids are alternatingly injected into a wellbore via a tubing string.

As an illustrative example, with reference to FIG. 2A, a cased injector well 2 has a tubing string 14 extending therethrough and a substantially horizontal section. An initializing resistivity flow monitor (RFM) unit 13 is installed on the tubing string 14 upstream of the injection zones 4 of the injection well 2 and configured to measure resistivity of fluid flowing through the bore 16 of the tubing string 14. For illustrative purposes, a simplistic four-zone injection well is described herein. A first RFM unit 12*a* is installed at the toe of the tubing string 14, and a fourth RFM unit 12*d* is installed at the heel of the tubing string 14. Second and third RFM units 12*b*,12*bc* can be installed on the tubing string 14 at intervals between the first and fourth units 12*a*,12*d* as shown. The first, second, third, and fourth RFM units 12*a*-12*d* are positioned upstream from respective first, second, third, and fourth injection zones 4*a*-4*d*.

Fluid 20 is injected into the injector well 2 through the tubing string bore 16, exits a downhole end of the tubing string, and flows uphole through the annulus 18, such that fluid 20 first exits the injector well 2 into the formation through a first injection zone 4*a* adjacent the toe of the tubing string 14 and downstream of the first RFM unit 12*a*. The injected fluid 20 then proceeds uphole through the annulus 18 and sequentially past the second, third, and fourth injection zones 4*b*-4*d*, each injection zone downstream of its respective RFM unit 12*b*-12*d*.

For the purposes of this example and ease of relative and demonstrative calculations, the bore 16 of the tubing string 14 and the annulus 18 can each be fancifully assigned a 1 $m^2$ cross-sectional flow area. The distance from the initializing RFM unit 13 to the first RFM unit 12*a* located adjacent to, and upstream of, the first injection zone 4*a* is 900 m, and the distance between the first RFM unit 12*a* and the subsequent second RFM unit 12*b*, located adjacent to and upstream of a second injection zone 4*b*, is 100 m.

If the fluid 20 is injected into the injector well 2 at 1 $m^3/s$, it will take 1000 seconds for the fluid to travel from the initializing RFM 13 to the second RFM 12*b* if no fluid exited the injection well 2 through the first injection zone 4*a*. However, if the fluid takes longer than 1000 seconds to travel from the initializing RFM 13 to the second RFM 12*b*, then it can be concluded that some fluid 20 exited into the hydrocarbon formation through the first injection zone 4*a*, assuming that the first injection zone 4*a* is the only available means for fluid 20 to exit the injector well 2. The flow rates of the injected fluid 20 between the various RFM units 12,13 can be calculated using the time it takes the fluid 20 to travel from one RFM to the next, calculated as the difference between fluid arrival times, and the known volume of the fluid conduit between the RFMs, calculated from the distance between the RFMs and the cross-sectional area of the fluid conduit.

Figure 2B:
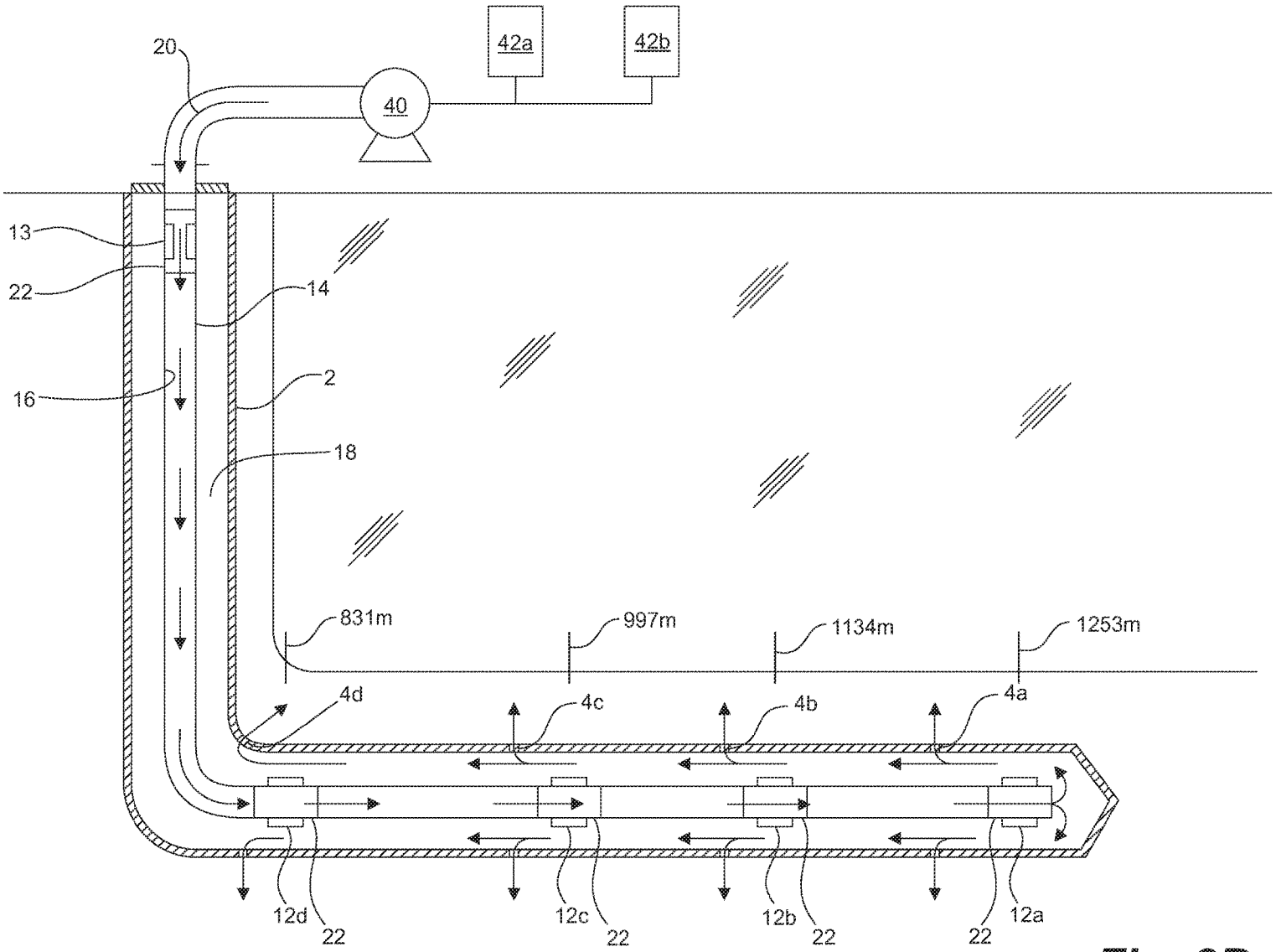
FIG. 2B is a schematic representation of a test system disclosed herein having five resistivity flow monitors positioned at specified depths for measuring resistivity of fluid flowing thereby, and wherein first and second fluids are alternatingly injected into a wellbore via a tubing string.
Figure 2C:
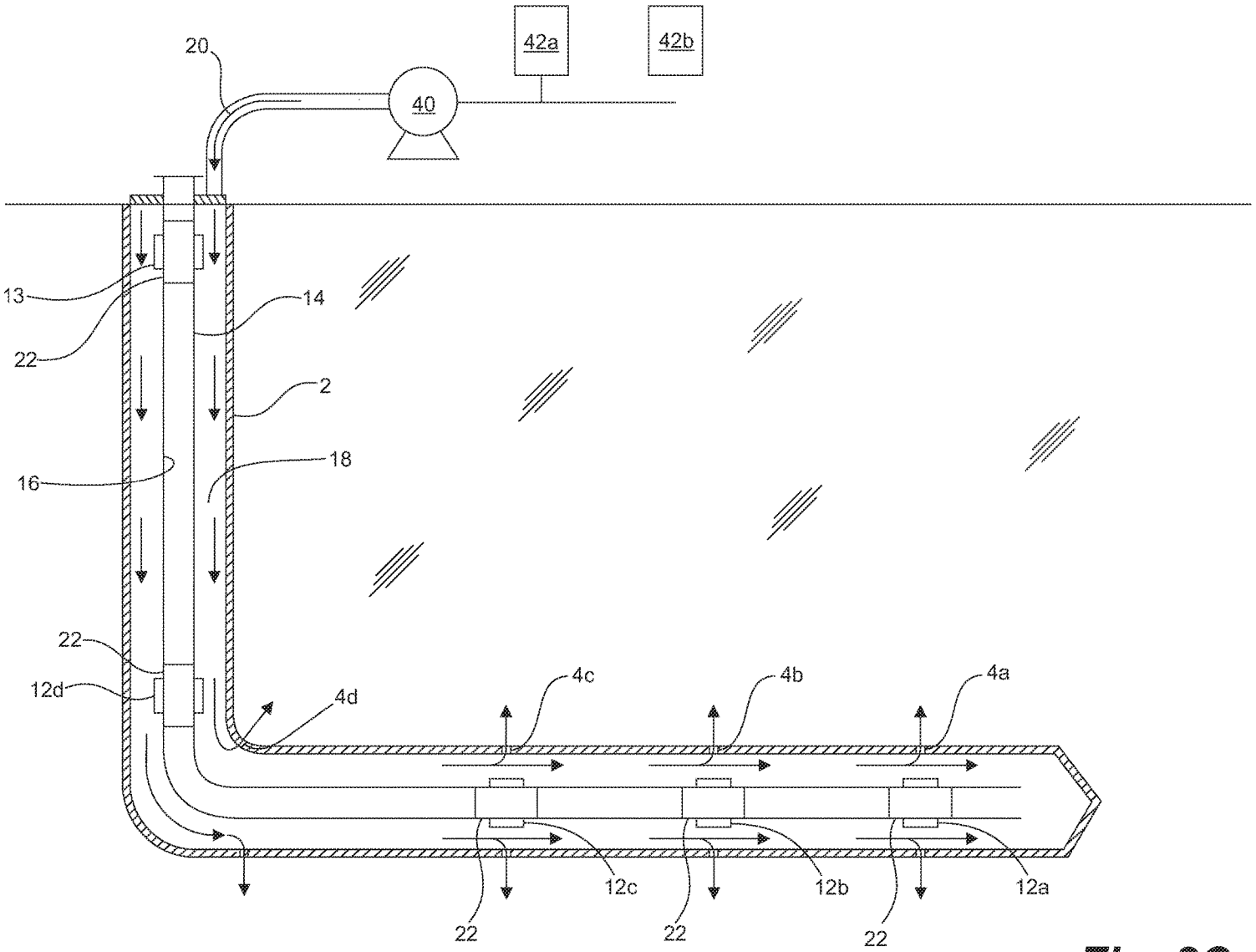
FIG. 2C is a schematic representation of another embodiment of a fluid flow monitoring system disclosed herein having five resistivity flow monitors, wherein first and second fluids are alternatingly injected into a wellbore via an annulus between a tubing string and wellbore casing.
Figure 2D:
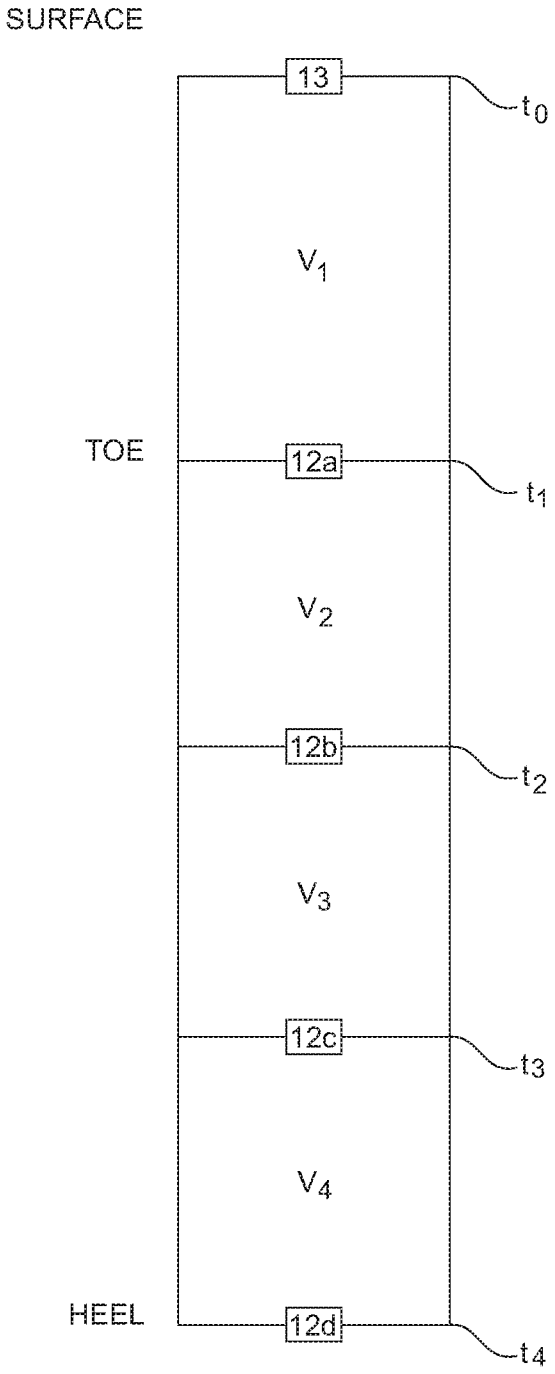
FIG. 2D is a representation of the volumes of the flow conduits of the injector well that injected fluid travels through to reach the resistivity flow monitors of the flow monitoring system of FIG. 2A, and the arrival times of the fluid at each of the resistivity flow monitors.

With reference to FIG. 2D, the rate of fluid flow from the initialization RFM 13 to the first RFM 12*a* can be determined with the equation:

$$Q_1 = \frac{V_1}{t_1 - t_0}$$

where $Q_1$ is the rate of fluid flow from the initialization RFM 13 to the first RFM 12*a;*

$V_1$ is the volume of the tubing extending from the initialization RFM 13 to the first RFM 12*a;*

$t_0$ is the time at which the injected fluid reaches the initialization RFM 13; and $t_1$ is the time at which the injected fluid reaches the first RFM 12*a;*

The rate of fluid flow from the first RFM 12*a* to the second RFM 12*b* can be determined using the equation:

$$Q_2 = \frac{V_2}{t_2 - t_1}$$

where $V_2$ is the volume of the annulus extending from the first RFM 12*a* to the second RFM 12*b* located adjacent to, and downstream from, the first injection zone 4*a*; and $t_2$ is the time at which the injected fluid reaches the second RFM 12*b*.

In a generalized form, the rate of fluid flow to an RFM 12*n* from a previous RFM 12*n*−1 can be determined using the equation:

$$Q_n = \frac{V_n}{t_n - t_{n-1}}$$

where $V_n$ is the volume of the annulus extending from the previous RFM 12$n$−1 to the RFM 12$n$;

$t_n$ is the arrival time of the injected fluid at the RFM 12$n$; and $t_{n-1}$ is the arrival time of the injected fluid at the previous RFM 12$n$−1

The flow rate of fluid flowing into the formation through the first injection zone 4$a$ can be calculated as $Q_1-Q_2$. The flow rate of fluid flowing into the formation through the second injection zone 4$b$ can be calculated as $Q_3-Q_2$. The low rate of fluid flowing into the formation through subsequent injection zones can be determined in a similar manner, where the flow rate through an injection zone located between RFMs 12$n$ and 12$n$−1 is $Q_n-Q_{n-1}$.

While the depicted flow monitoring system 10 shows the initializing RFM 13 located near surface, the initializing RFM 13 can be installed at any location of the injector 2 upstream of the first injection zone 4$a$. So long as the distances between the various RFMs 12,13 and the cross-sectional area of the fluid conduit therebetween are known, and the injection rate of fluid 20 into the injector well 2 (before the fluid reaches the first injection zone) is known, the fluid flow rate out of the injection zones 4 can be calculated in the manner described above. As discussed above, if the flow rate of fluid into the injection well 2 is not known, then at least two RFMs 12 can be installed upstream of the first injection zone 7$a$ for calculating the initial flow rate $Q_1$, assuming that substantially no fluid 20 has exited the injector well 2 between the two RFMs 12. For example, the initializing RFM 13 and the first RFM 12$a$ of FIG. 2A can be used to calculate the initial flow rate $Q_1$. $Q_1$ can also be measured at the pumping system 40. For example, for positive displacement pumps, each stroke of the pump displaces a known volume of fluid. Thus, the speed of the pump, e.g. the strokes per minute, can be multiplied with the displacement volume of the pump to obtain the flow rate.

Fluid Injection Through Annulus

While the embodiments shown in FIGS. 2A and 2B contemplate fluids 20 being injected into the injector well 2 through the tubing string 14, other configurations are also possible. For example, in embodiments, and as depicted in FIG. 2C, fluid 20 can be injected into the annulus 18 of the injector well 2. As with embodiments wherein fluids 20 are injected through the tubing string 14, fluid flow sensors 12 can be placed upstream (in this instance, uphole) of each fluid injection zone 4 to detect the arrival of the fluids 20 thereat. When fluids 20 are injected into the injector well 2 through the annulus 18, the fluids first exit the injector well 2 into the formation through a first injection zone 4$a$ adjacent the heel of the tubing string 14 and then sequentially through second, third, and fourth injection zones 4$b$-4$d$, each subsequent injection zone located downstream of the previous zone.

Fluid flow rates through the various injection zones 4 of the injection well 2 into the hydrocarbon formation can be calculated in a manner similar to the calculations above, with $V_1$ being the volume of the annulus extending from the initialization RFM 13 to the first RFM 12$a$.

System Embodiments

FIG. 1 shows an embodiment of a water-flooding, secondary production operation with a flow monitoring system 10 located within an injector well 2 having a plurality of injection zones 4 through which fluid 20 injected into the injector bore may be introduced into the hydrocarbon formation for transport and displacement through the formation to the producer well 6.

As mentioned above, as shown in FIGS. 2A and 2B, a plurality of RFMs 12 are axially spaced along a tubing string 14 located inside of the injector well 2, and configured to measure the resistivity of the fluid 20 flowing thereby.

The RFMs 12 can be located on flow subs 22 (detailed in FIG. 4A) positioned along a string of jointed tubing making up the tubing string 14 to be run into the injection well. The RFMs 12 (12$a$,12$b$,12$c$ . . . 12$n$) can be configured to measure the resistivity of fluid 20 flowing through the annulus 18 formed between the tubing string 14 and the injector well casing, the bore 24 of the flow sub 22 or the tubing string bore 16, or both, depending on the type of fluid flooding operation implemented.

The flow subs 24 are positioned at intervals along the tubing string 14, such that at least one RFM 12 is located upstream of each injection zone 4 (4$a$,4$b$,4$c$ . . . 4$n$) when the tubing string 14 is run in hole to the desired depth and hung in an operating position. The initializing RFM 13 can be located on a flow sub 22 installed on the tubing string 14 upstream of the injection zones 4. A flow sub 22 can also be positioned downstream of the last injection zone 4$n$. The distances of the RFMs 12,13 from surface, and the distances between the various RFMs 12,13, are known.

In embodiments, power is supplied to the RFMs 12 via a portable power-source 26 located in the flow sub 22, and the resistivity data acquired by the RFMs 12 is stored in on-board memory modules 28 also located in the flow subs 22. In other embodiments, power is supplied via an external power source 30 located at surface and connected to the flow subs 22 via a wireline 34 or other suitable means. Similarly, the resistivity data acquired by the RFMs can be stored on an external data storage unit 32 located at surface and connected to the flow subs 22 via wireline 34. In such embodiments, the flow subs 22 can have on-board power sources 26 and memory modules 28 as a backup to the surface power source 30 and data storage unit 32.

Figure 8A:
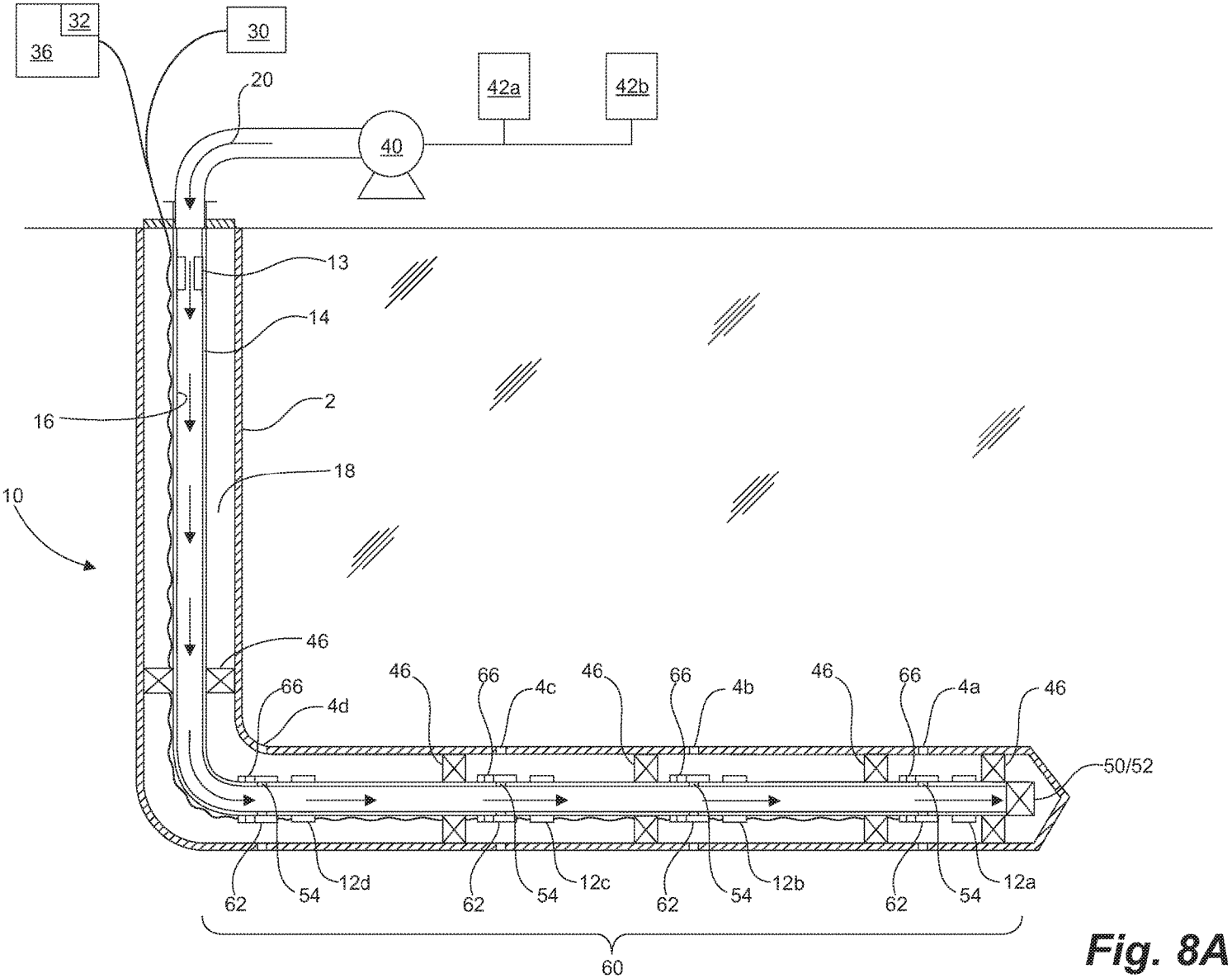
FIG. 8A is a schematic representation of a flow monitoring system in combination with a flow control system having control sleeves in a fully closed position implemented in an injector well.

Having reference also to FIG. 8A, a controller 36, such as a computer, can be used to calculate the fluid flow rates of the injection zones 4 using the resistivity data acquired by the RFMs 12 and stored in the surface data storage unit 32 or on-board memory modules 28. In embodiments wherein the RFMs 12 are connected to surface equipment, the resistivity data can be transmitted to the controller in real-time or near real-time, such that the calculated flow rates out of the injection zones 4 substantially represent real-time flow rates.

In embodiments, the controller 36 can be directly connected to the data storage unit 32 or an uphole end of the wireline 34 to receive resistivity data. The controller 36 can also be remotely connected to the flow monitoring system 10. For example, as shown in FIG. 8C, a wireless communications interface 38 at surface can be connected to the data storage unit 32 or uphole end of the wireline 34, and configured to interface with a controller 36 via any suitable wireless communications network such as a cellular network, Bluetooth, and the like. The controller 36 can be any device capable of communication using the above communications networks, such as a personal computer, laptop, tablet, smartphone, and the like.

Figure 4A:
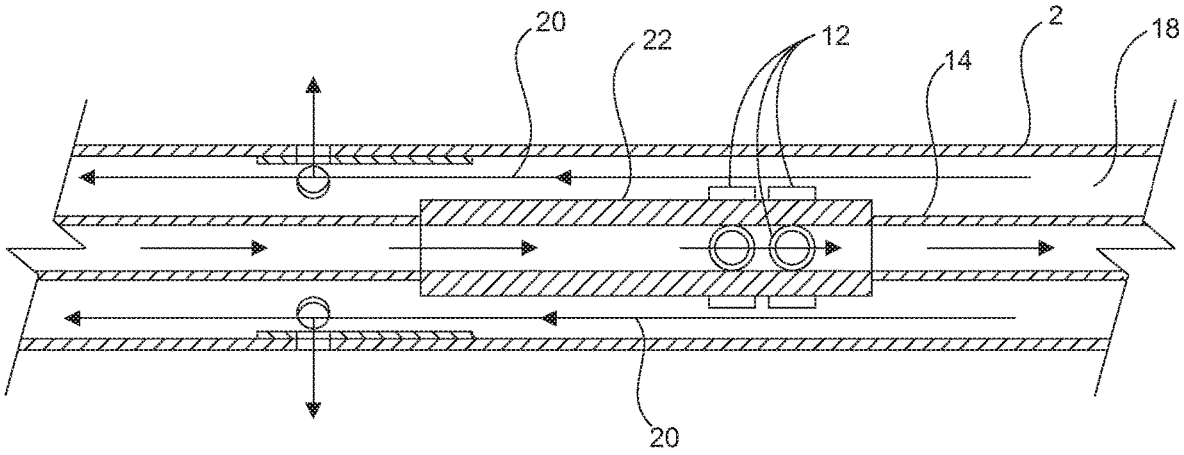
FIG. 4A is a cross-sectional side view of a resistivity flow monitor of an embodiment of a fluid flow monitoring system disclosed herein.
Figure 4B:
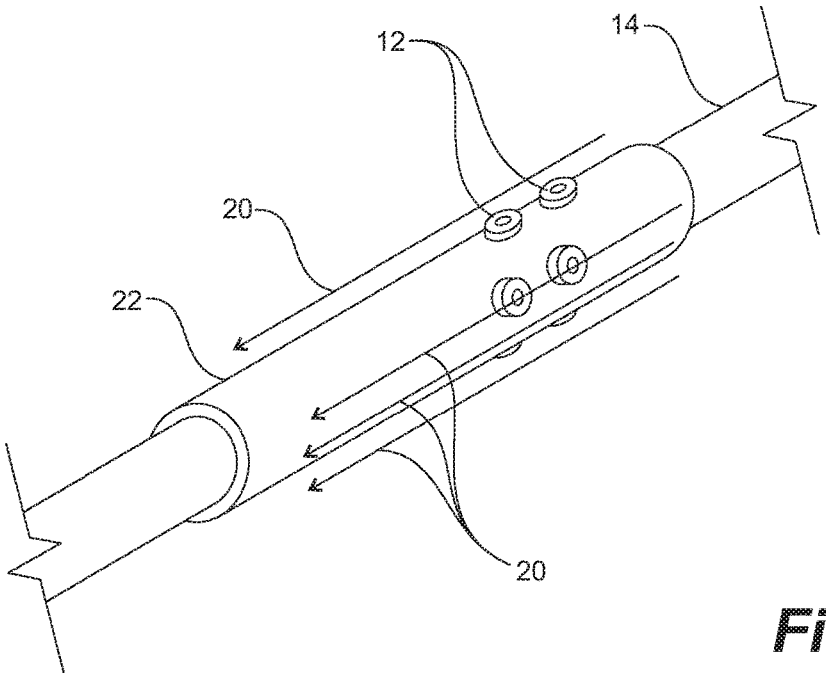
FIG. 4B is a partial isometric view of the resistivity flow monitor of FIG. 4A.

In embodiments, with reference to FIGS. 4A and 4B, each flow sub 22 can have multiple RFMs 12 spaced radially thereabout. Such a configuration is advantageous in wellbores having substantively horizontal segments, where hydrocarbons and other materials having a different viscosity than water can accumulate. In such wellbores, the flow rate of fluid at an upper cross-sectional portion of the wellbore is different than the flow rate at a lower cross-sectional portion. The flow rates measured by the radially spaced RFMs of an injection zone can be averaged to obtain the overall flow rate. For example, the arrival times of the first or second fluid 20 at the flow sub 22 can be averaged and the flow rate calculated from the averaged arrival time. The average arrival time can be a simple average, a weighted average, a median, or another suitable composite calculated from the measurements of the RFMs 12 of the flow sub 22. Flow rate data that falls outside an expected range can be discarded as necessary.

Alternatively, the calculated volume of fluid flowing in the wellbore can be adjusted. This might be the case if some of the RFMs 12 did not observe any noticeable changes in resistivity. If this is combined with orientation data of the RFMs 12, and the RFMs 12 that did not observe any noticeable resistivity changes are located on the "bottom" of the horizontal section of the wellbore, it can be inferred that fluid flow through a portion of the cross-sectional area of the wellbore is being inhibited, for example by sand or sediment produced from formation. One could then adjust the volume of fluid moving and hence the calculated flow rate through the portion of the cross-sectional area of the wellbore experiencing inhibited flow. Since volumetric measurements of fluid are not obtained continuously along the horizontal wellbore section, but are only estimated at locations having RFMs 12, these flow rate calculations may not be as accurate as if the wellbore was clean and there is free flow through all cross-sectional portions thereof.

Figure 3:
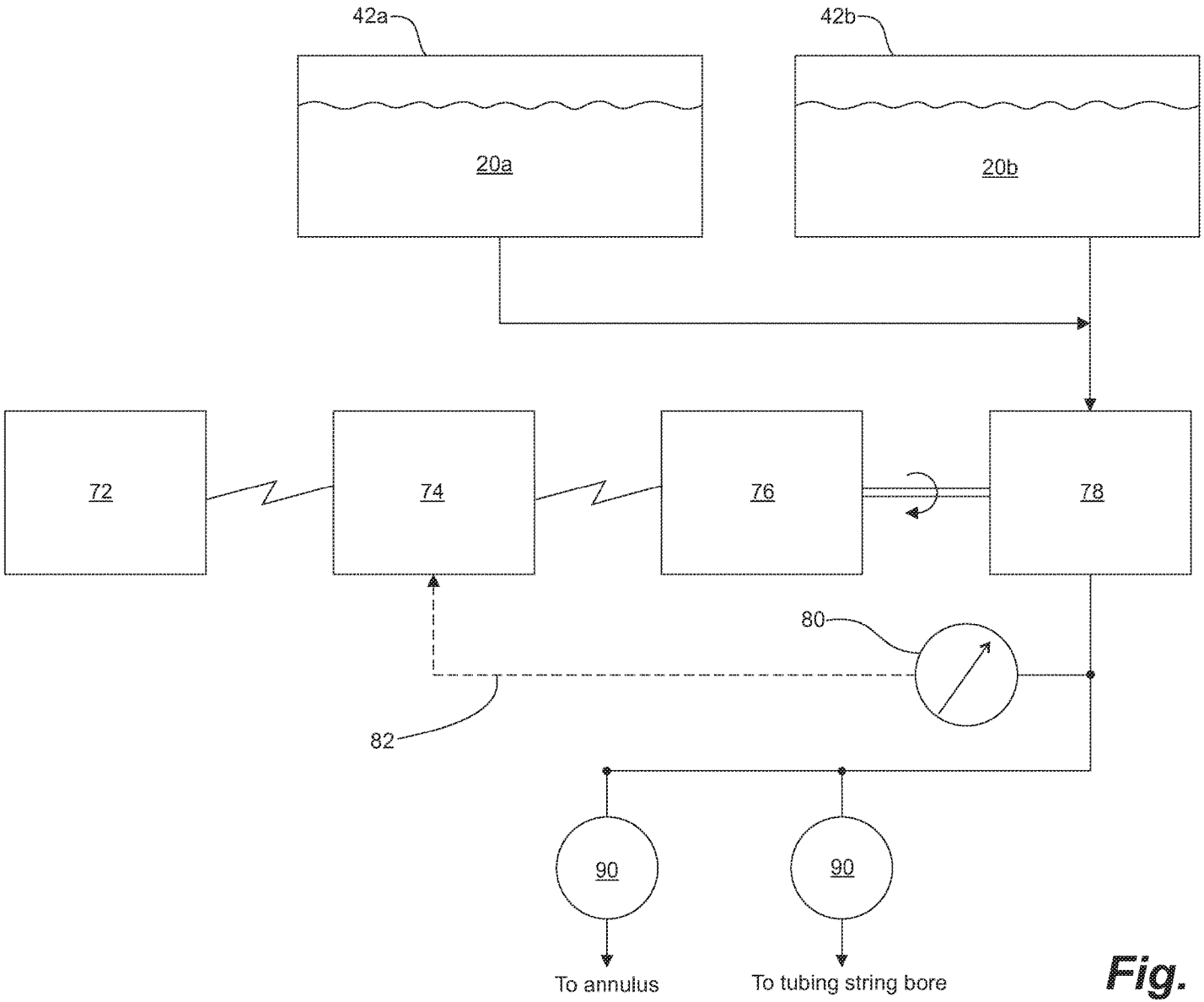
FIG. 3 is a schematic representation of a pumping system of an embodiment of a fluid flow monitoring system.

With reference to FIGS. 1 and 3, a pump system 40 at surface is configured to alternatingly pump the first and second fluids 20*a*,20*b* from first and second fluid sources 42*a*,42*b*, respectively, into the injector bore. In the depicted embodiment, the first fluid source 42*a* contains clean water 20*a* having a first resistivity level, and the second fluid source 42*b* contains saline water 20*b* having a second resistivity level that is lower than the first resistivity level. The salt content of the salt water 20*b* is selected such that the resistivity thereof can be sufficiently differentiated from the resistivity of the clean water 20*a* when measured by the RFMs 12.

Referring now to FIG. 3, in an embodiment, the pump system 40 can comprise a generator 72 for supplying power to an electric motor 76 operatively coupled to a pressure pump 78, such as a triplex plunger pump. The pump 78 is fluidly connected to the first and second fluid sources 42*a*,42*b* and the tubing string bore 16 and/or annulus 18 of the injector well 2 and configured to deliver the first and second fluids 20*a*,20*b* thereto. A variable frequency drive (VFD) 74 can be connected between the generator 72 and motor 76 for adjusting the speed of the motor 76 and pumping rate. Flowmeters 90 can be located along the fluid lines leading to the tubing string bore 16 and annulus 18 to measure the flow rate of the fluids 20 being delivered thereto.

To maintain the pressure in the fluid line connecting the pump 78 and the tubing bore 16/annulus 18, a pressure gauge 80 can be configured to measure the pressure in the fluid line, and an electrical control line 82 can connect the pressure gauge 80 and the VFD 74. The VFD 74 can be configured to adjust the speed of the motor 76 and flow rate in response to the pressure readings from the pressure gauge 80 in order to maintain pressure in the fluid line within a desired pressure range.

The pump system 40 can be configured to inject the fluids 20*a*,20*b* into the injection well 2 at a substantially constant flow rate, such that the fluid injection rate does not change substantially from the time a fluid reaches the first of the RFMs 12 to the time the fluid reaches the last of the RFMs 12. A stable fluid injection rate throughout the flow rate monitoring process is desirable in order to establish measures of flow rates and provide more accurate calculations of the established flow rates at the various RFMs 12.

If the injection rate of fluids 20 into the injection bore 2 is not stable, the percentage of fluid lost between two adjacent RFMs 12 may still be calculated if the total volume of injected fluid 20 is known between the arrival time of the fluid at an RFM and the arrival time at a subsequent RFM. For example, the total injected volume of fluid between the arrival time at the initialization RFM 13 and the arrival time at the first RFM 12*a* is equal to some value measured as volume/minute, which could be compared to the volume of the flow conduit between initialization and first RFM 13,12*a* divided by the same time interval—which would allow for the calculation of what percentage of fluid is exiting the injection bore between those two RFMs.

Figure 5A:
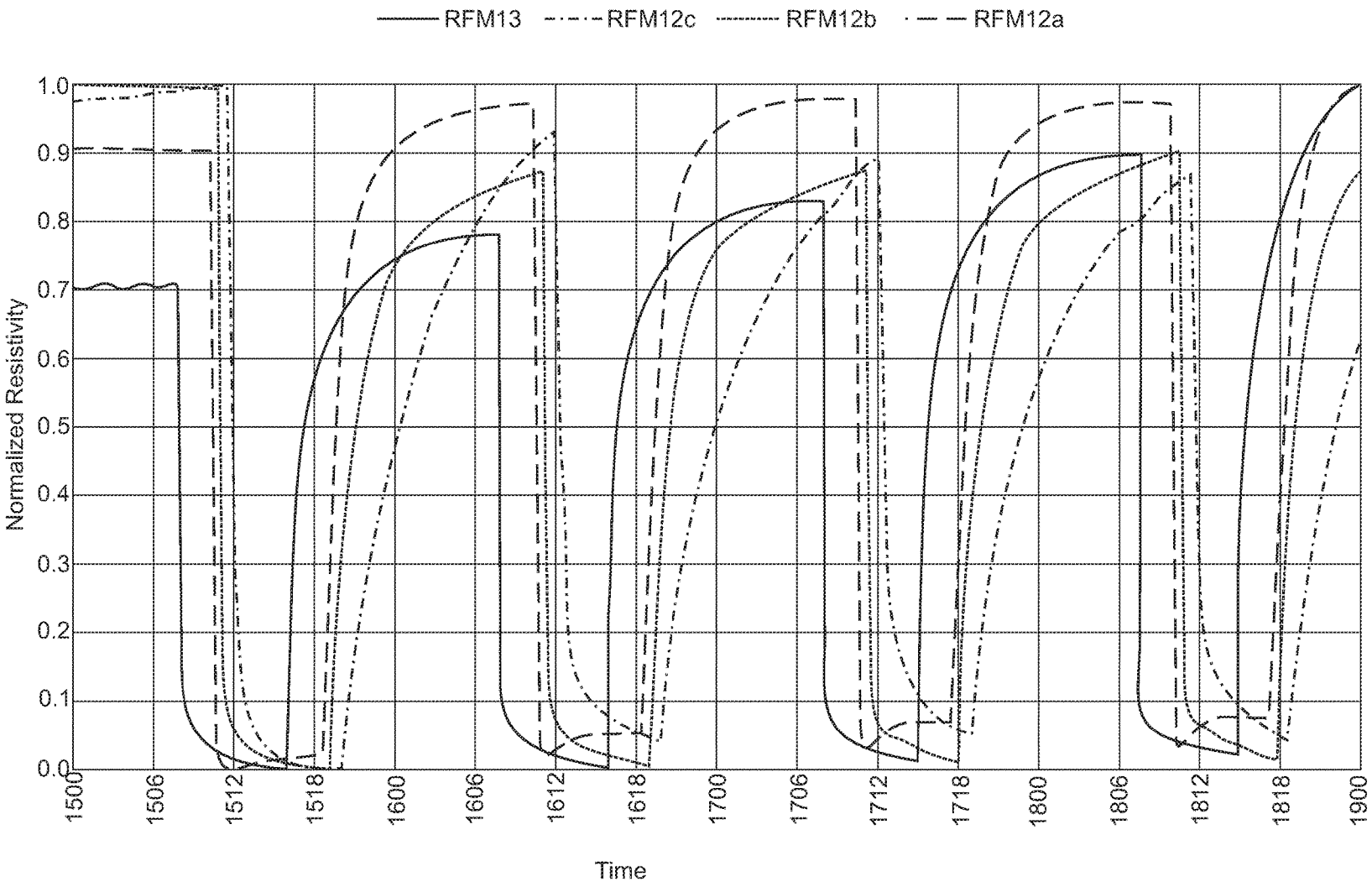
FIG. 5A is a normalized graphical representation of the resistivity over time measured by the resistivity flow monitors of the embodiment of FIG. 2B.
Figure 5B:
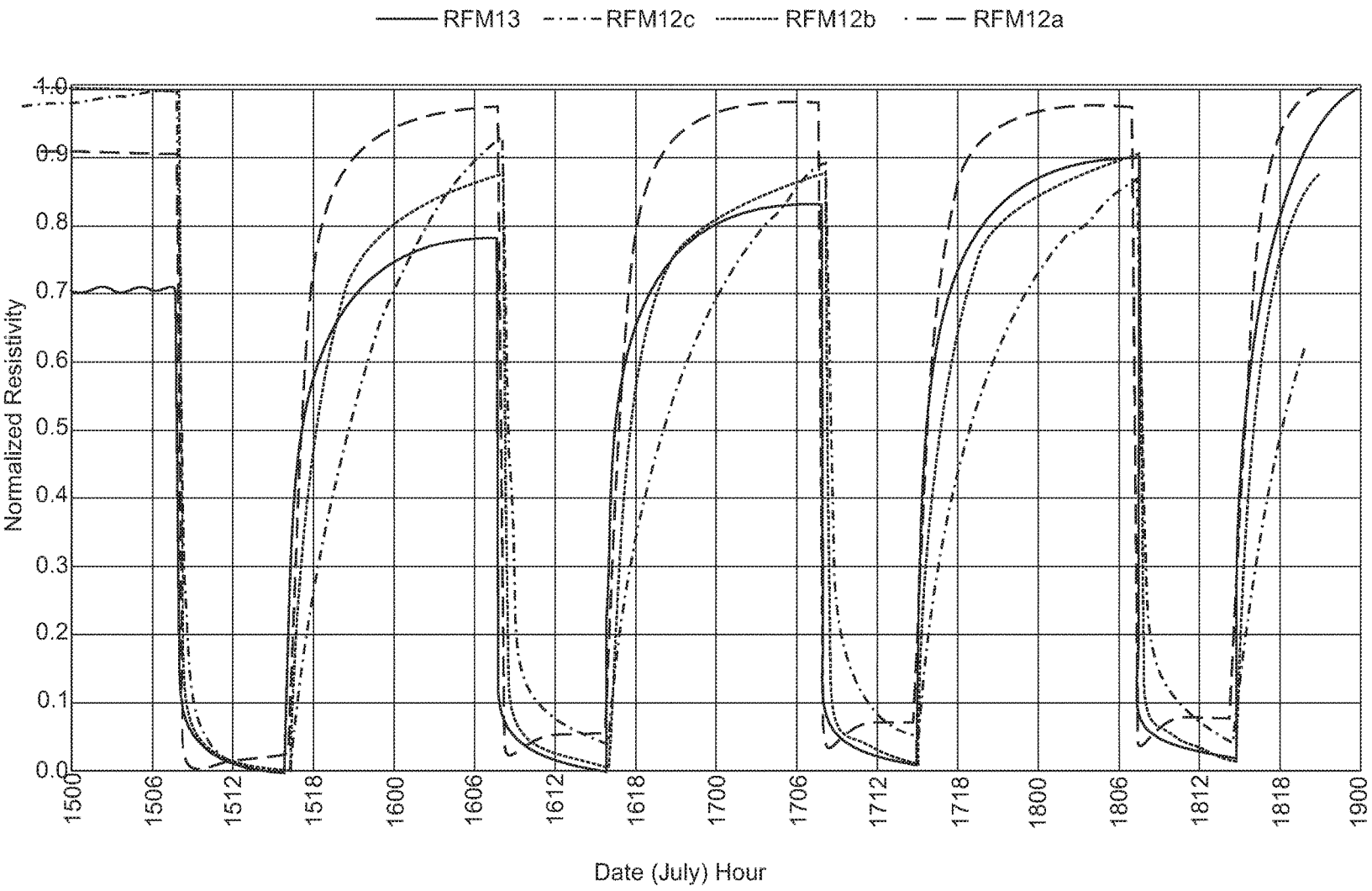
FIG. 5B is a time-aligned version of the graphical representation of FIG. 5A, illustrating the similarity of the temporal resistivity measurements of the various RFM units.
Figure 5C:
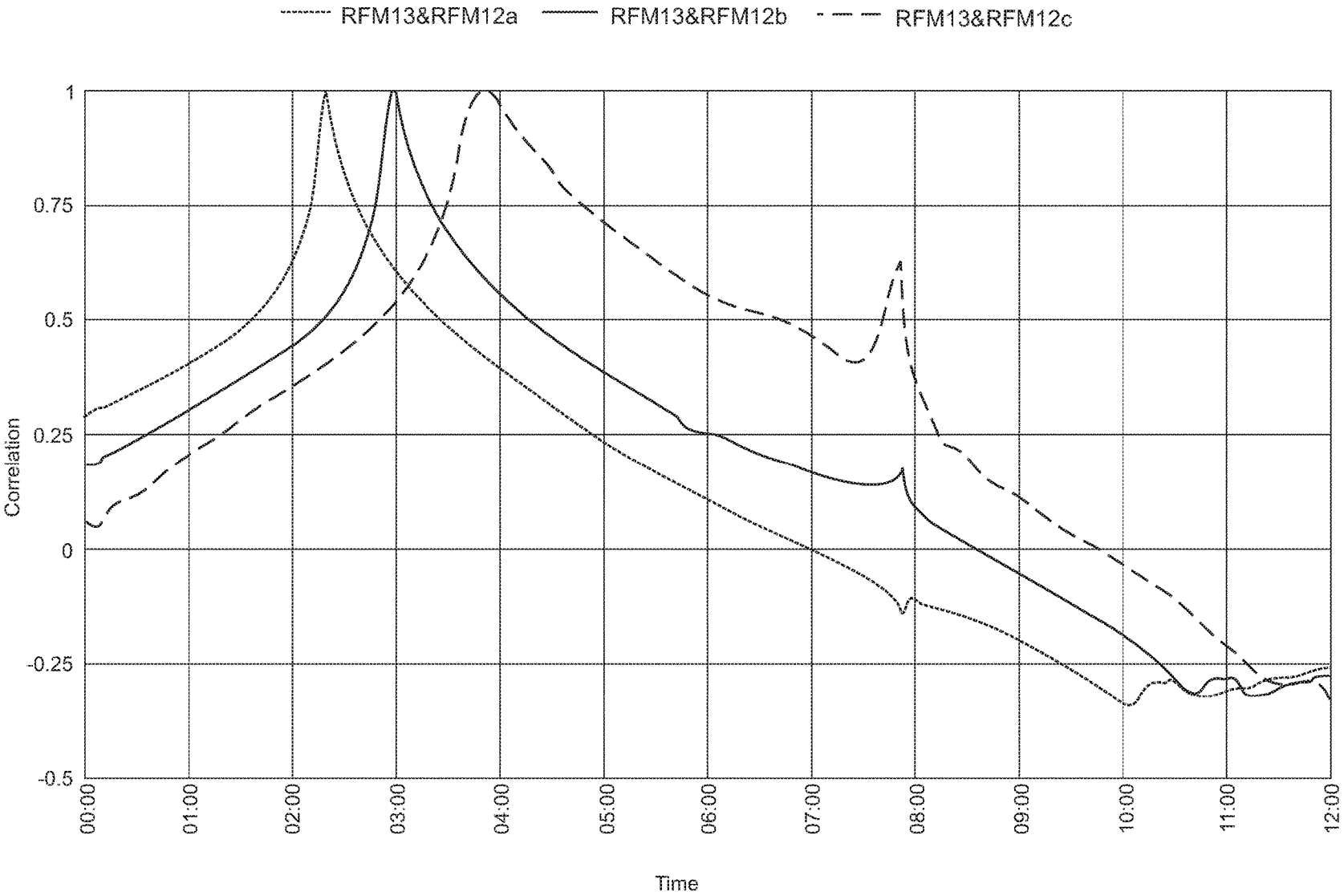
FIG. 5C is a graphical representation of the resistivity data measured by the resistivity flow monitors of the embodiment of FIG. 4A cross-correlated with each other.
Figure 7:
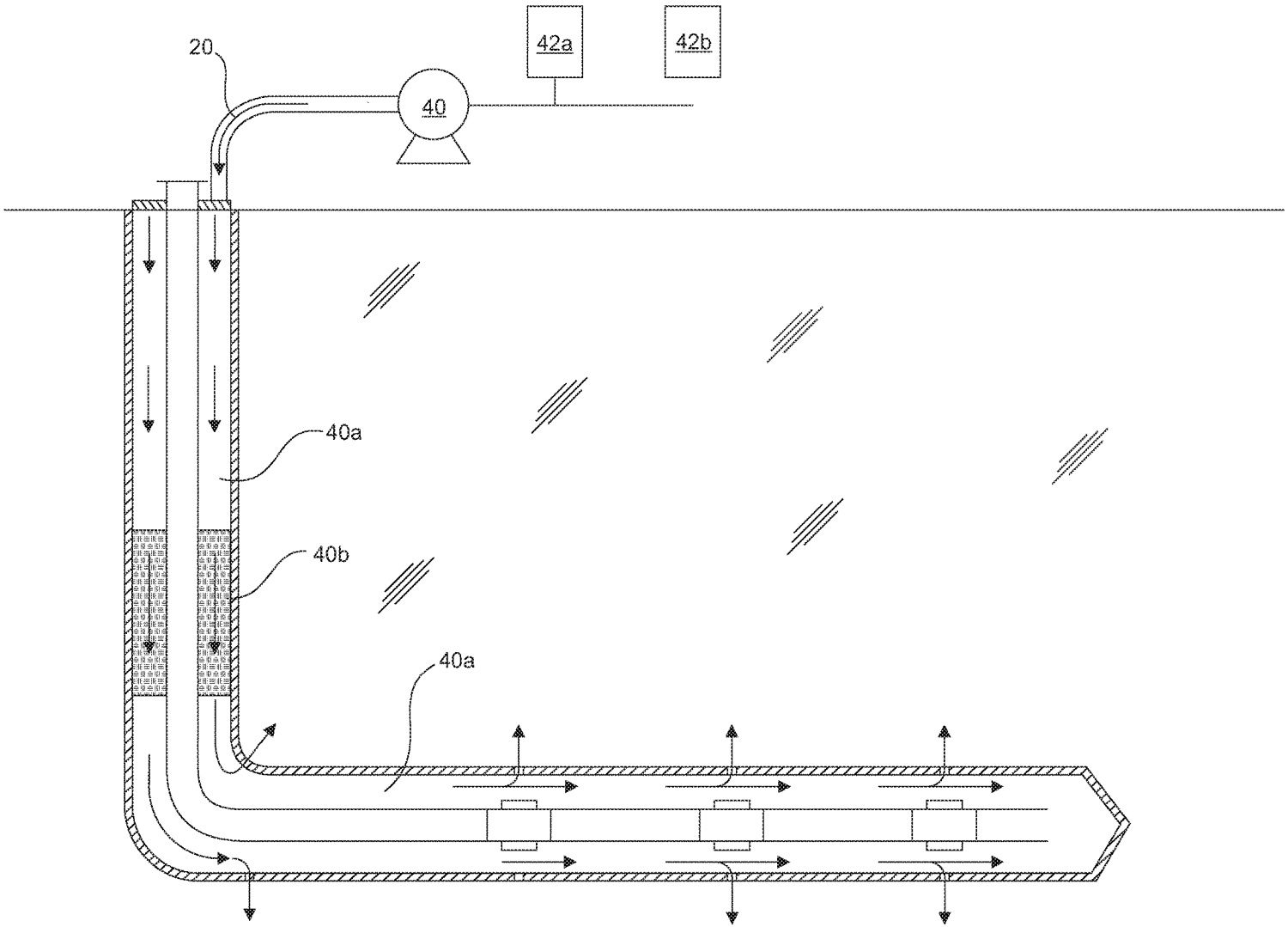
FIG. 7 is a schematic representation of another embodiment of the fluid flow monitoring system disclosed herein, wherein fluid is injected via the annulus of a wellbore and a "slug" of salt water is injected between injections of clean water.

In use, as shown in FIG. 7, the pump system 40 alternatingly pumps the clean water 20*a* and the salt water 20*b* downhole into the injector well 2. The RFMs 12 measure and log resistivity measurements of the fluids 20*a*,20*b* flowing thereby over time. Significant changes to the resistivity measured by the RFMs 12 are indicative of a change in the fluid from salt water 20*b* to clean water 20*a* and vice versa. For example, as shown in FIGS. 5A-5C, as clean water 20*a* flows by an RFM, the resistivity detected by an RFM 12 is relatively high. As the clean water 20*a* changes to salt water 20*b*, the resistivity detected by the RFM 12 drops significantly. On a sufficiently large time scale, for example over the course of several hours or days, the resistivity change at a given RFM 12 is dramatic and abrupt, and therefore the arrival of the clean water 20*a* or salt water 20*b* is easily discernable. The time at which each RFM 12 detects a significant change in resistivity is logged to determine the time that the clean water 20*a* or salt water 20*b* arrived at the RFM 12. The recorded arrival times can subsequently be used to calculate the flow rate of fluid out of the injection well 2 at each injection zone 4.

In embodiments, the fluids 20*a*,20*b* are injected downhole through the tubing string bore 16 and flow uphole towards surface through the annulus 18, exiting to the hydrocarbon formation via the injection zones 4, beginning with the most downhole injection zone. In other embodiments, the fluids 20*a*,20*b* are injected downhole through the annulus 18 and exit to the hydrocarbon formation via the injection zones 4, beginning with the most uphold injection zone.

In another embodiment, a plurality of packer subs 44 each having an isolation packer 46 are located along the tubing string 14 and are selectively deployable to isolate each of the injection zones 4. A toe sub 50 having a toe valve 52 is located at a downhole end of the tubing string 14 for preventing fluid communication out of the tubing string bore 16 via said downhole end. The isolation packers 46 can be inflatable packers that are expandable by pressurizing the tubing string bore 16, such as by closing the toe valve 52 and injecting fluid into the tubing string bore 16 to increase the pressure therein. Fluid communication between the tubing string bore 16 and the isolation packers 46 can be controlled by a packer valve 48 of each of the isolation packers 46. The packer valves 48 can be opened to permit fluid communication between the packer elements 46 and the tubing bore 16, such as when setting or collapsing the packer elements 46. The packer valve 48 can be closed to prevent fluid communication between the packer elements 46 and the tubing string bore 16, such as when the packer elements 46 are to be maintained in the set position. The tubing string 14 can have tubing string ports 54 located adjacent the locations of the injection zones 4 for permitting fluid communication between the tubing string bore 16 and the annulus 18. In such embodiments, the RFMs 12 can be configured to measure the resistivity of fluid 20 flowing inside the tubing string bore 16 and are each located upstream of respective ports 54 of the tubing string. Alternatively, the RFMs 12 can be configured to measure the resistivity of fluid 20 in the annulus to detect the arrival times of the injected fluid 20 therein.

When the isolation packers 46 are set and the toe valve 52 is closed, fluid 20 injected into the tubing string bore 16 can only flow into the annulus 18 out of the ports 54 of the tubing string, and thereafter out of the injection zones 4 of the injection well 2. Measurement of resistivity and calculation of the fluid flow rates out of the injection zones 4 can be carried out as described above.

In embodiments, the packer subs 44 and toe sub 50 can be connected to the power source 30 and controller 36 at surface via the wireline 34. The controller 36 can be configured to open and close the packer valves 48 as required to set and unset the packer elements 46, and also to open and close the toe valve 52. The controller 36 can also be configured to monitor the operation of the packers 46, such as monitoring packer bladder pressure for confirming successful setting of the packer.

While the isolation packers 46 described above are set by pressurizing the tubing string bore 16, in other embodiments, the isolation packers 46 can be set by other means such as rotation of the tubing string 14, or can otherwise be pressure, mechanically, or electrically activated.

In embodiments, the flow monitoring system 10 can be used in a production well 6 to determine the flow rate of fluid into the production well through various fluid-receiving zones 8, such as perforations or open ports formed in the production well casing. In such embodiments, a tubing string 14 having a plurality of RFMs 12 installed therealong is run into the production well 6 such that the RFMs 12 are located adjacent to the fluid-receiving zones 8, and fluids 20*a*,20*b* are alternatingly injected into the production well 6 through the tubing string 14. The rate of fluid flow into the formation through the various fluid-receiving zones 8 can be calculated using the methods disclosed above. Assuming that the flow behavior of fluid travelling from the production well 6 into the formation is substantially the same as the behavior of fluid flow from the formation into the production well 6, this method can be used to determine the flow rate of fluid into the production well 6 through its various fluid-receiving zones 8.

Flow Control System

The injection well can also comprise a flow control system 60 for adjusting the flow rate of fluids through the injection zones 4 of the injection well 2 in response to the flow information obtained from the flow monitoring system 10. For example, flow through the injection zones 4 can be adjusted to produce more uniform flow rates across the injection zones 4, resulting in a more uniform flood front and improving production.

In an embodiment, the flow control system 60 comprises a plurality of flow control devices 62 installed along the tubing string 14 or the injector well casing. When installed along the tubing string 14, the control devices 62 can be actuated to adjust fluid communication between the tubing string bore 16 and the annulus 18 via the ports or openings 54 of the tubing string 14. When installed along the wellbore casing, the control devices 62 can be actuated to adjust fluid communication between the annulus 18 and the hydrocarbon formation via the injection zones 4. Each flow control device 62 is capable of actuation between a closed position, wherein the devices prevents fluid communication therethrough, and an open position, wherein the device permits fluid communication therethrough. One device in a zone 4 opens or shuts off flow thereto. A plurality of devices along a zone 4 permits finer control of the adjustment of fluid communication to the zone through selective opening and closing of such devices.

In embodiments, the flow control devices 62 are actuable to various positions intermediate the open and closed positions, thereby allowing the fluid flow rate therethrough to be tuned to produce the desired fluid flow characteristics. In some embodiments, the flow control devices 62 are infinitely adjustable. In other embodiments, the flow control devices 62 are adjustable between a plurality of discrete, finite positions.

In the embodiment depicted in FIG. 8, the flow control devices 62 are electrically actuable, each device 62 being operatively connected to a respective drive mechanism 64, such as an electric motor, configured to actuate the flow control devices 62 to their various positions. The drive mechanisms 64 can be connected to the power source 30 and controller 36 at surface via the wireline 34, similarly to the flow subs 22 and packer subs 44. As described above, the controller 36 receives resistivity data from the flow monitoring system 10 and calculates the fluid flow rates of the injection zones 4. The controller 36 can also be configured to transmit instructions to the drive mechanisms 64 of the flow control devices 62 to adjust fluid flow through the injection zones 4 in response to the calculated fluid flow data. The controller 36 can be capable of adjusting the flow control devices 62 individually as well as collectively. Preferably, the receipt of resistivity data, calculation of fluid flow rates, and the transmission of instructions to the flow control system 60 takes place in real-time or near real-time, such that the fluid flow characteristics of the injector well 2 can be monitored and adjusted quickly as fluid flow conditions change. In embodiments, the adjustments transmitted to the fluid control system 60 are selected manually. In other embodiments, the adjustments are selected and transmitted automatically.

Preferably, the RFMs 12, isolation packers 46, flow control devices 62, and other components of the flow monitoring and flow control systems 10,60 are made of a corrosion-resistant material such as stainless steel or ceramics, as wellbore fluids, as well as the introduction of salt water, can cause significant corrosive wear on equipment within the wellbore.

Figure 8B:
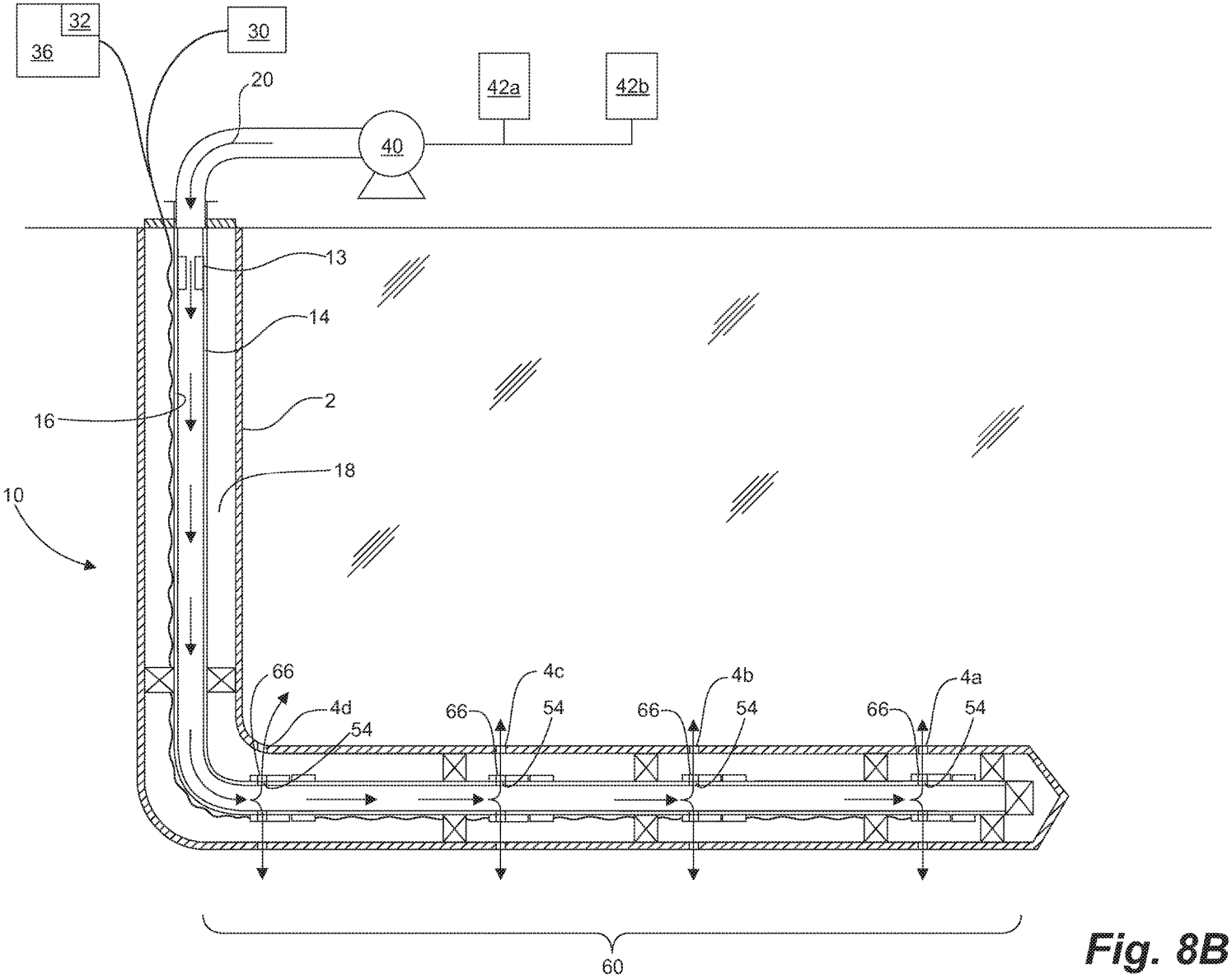
FIG. 8B is a schematic representation of the flow monitoring and control system of FIG. 8A wherein the control sleeves are in the fully open position.
Figure 8C:
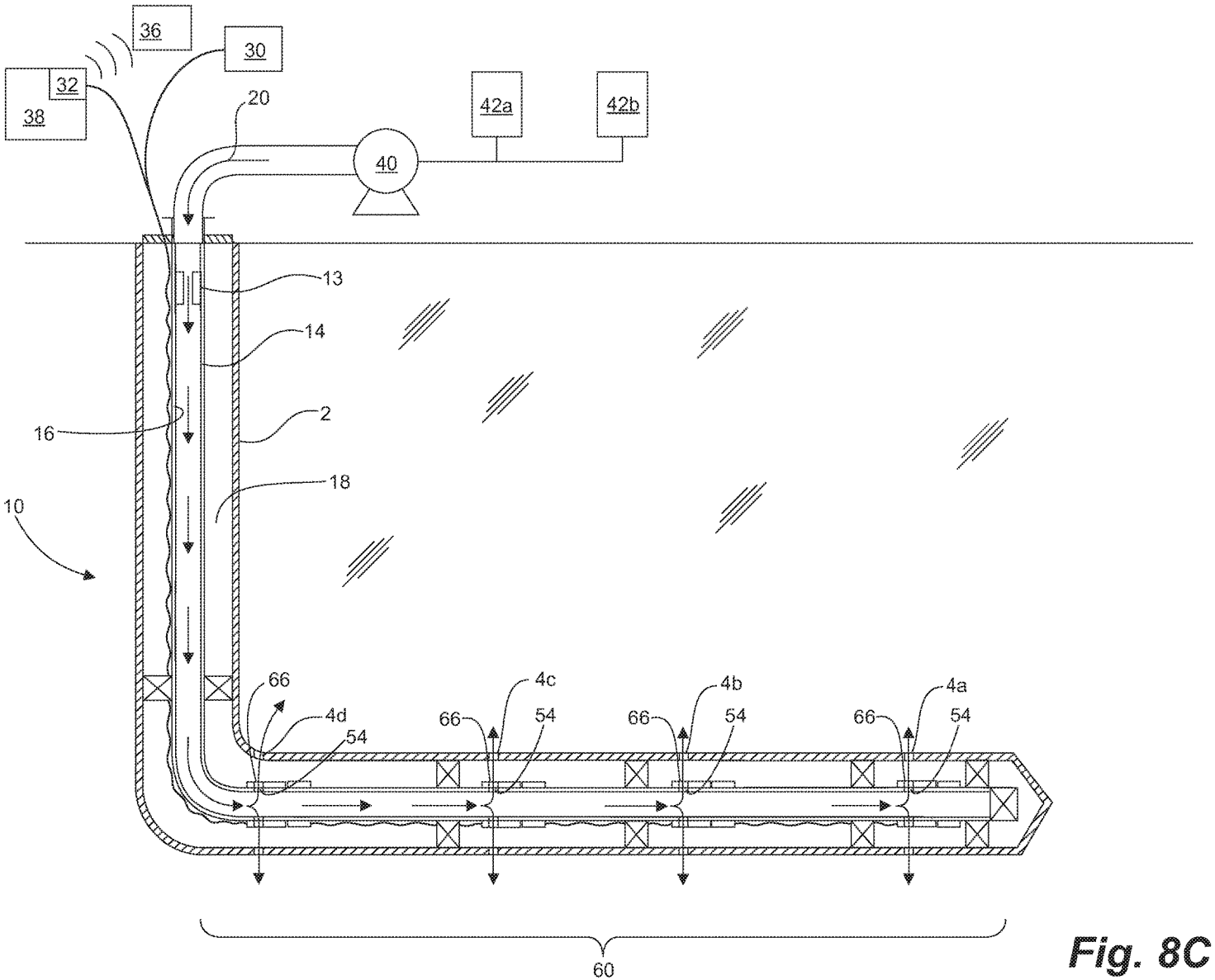
FIG. 8C is a schematic representation of the flow monitoring and control system of FIG. 8B having a wireless communications interface at surface.

In an exemplary flow monitoring and control system 10,60 depicted in FIGS. 8A-8C, the flow monitoring system 10 comprises a plurality of RFMs 12 axially spaced along a tubing string 14, and one initializing RFM 13 located on the tubing string 14 upstream of the other RFMs 12. The RFMs 12,13 are configured to detect the resistivity of the fluid 20 flowing thereby in the tubing string bore 16. The flow control system 60 comprises a plurality of actuable control sleeve valves 62 spaced along the tubing string 14. The control sleeves 62 are each operatively connected to a respective drive mechanism 64 configured to actuate the control sleeves 62 between a fully open position, wherein sleeve flow ports 66 of the sleeves 62 are aligned with respective ports 54 of the tubing string 14, and a fully closed position, wherein the sleeve flow ports 66 are misaligned with the tubing string ports 54. The sleeves 62 are also capable of being actuated to a number of intermediate positions between the fully opened and fully closed positions.

Isolation packers 46 are axially spaced along the tubing string 14 for isolating fluid flow between the injection zones 4 via the annulus 18 when set. A toe sub 50 having a toe valve 54 is located at a downhole end of the tubing string 14 for selectably preventing fluid from exiting the tubing string bore 16 from the downhole end. The isolation packers 46 are expandable by opening packer valves 48 thereof and pressurizing the tubing string bore 16.

Figure 11A:
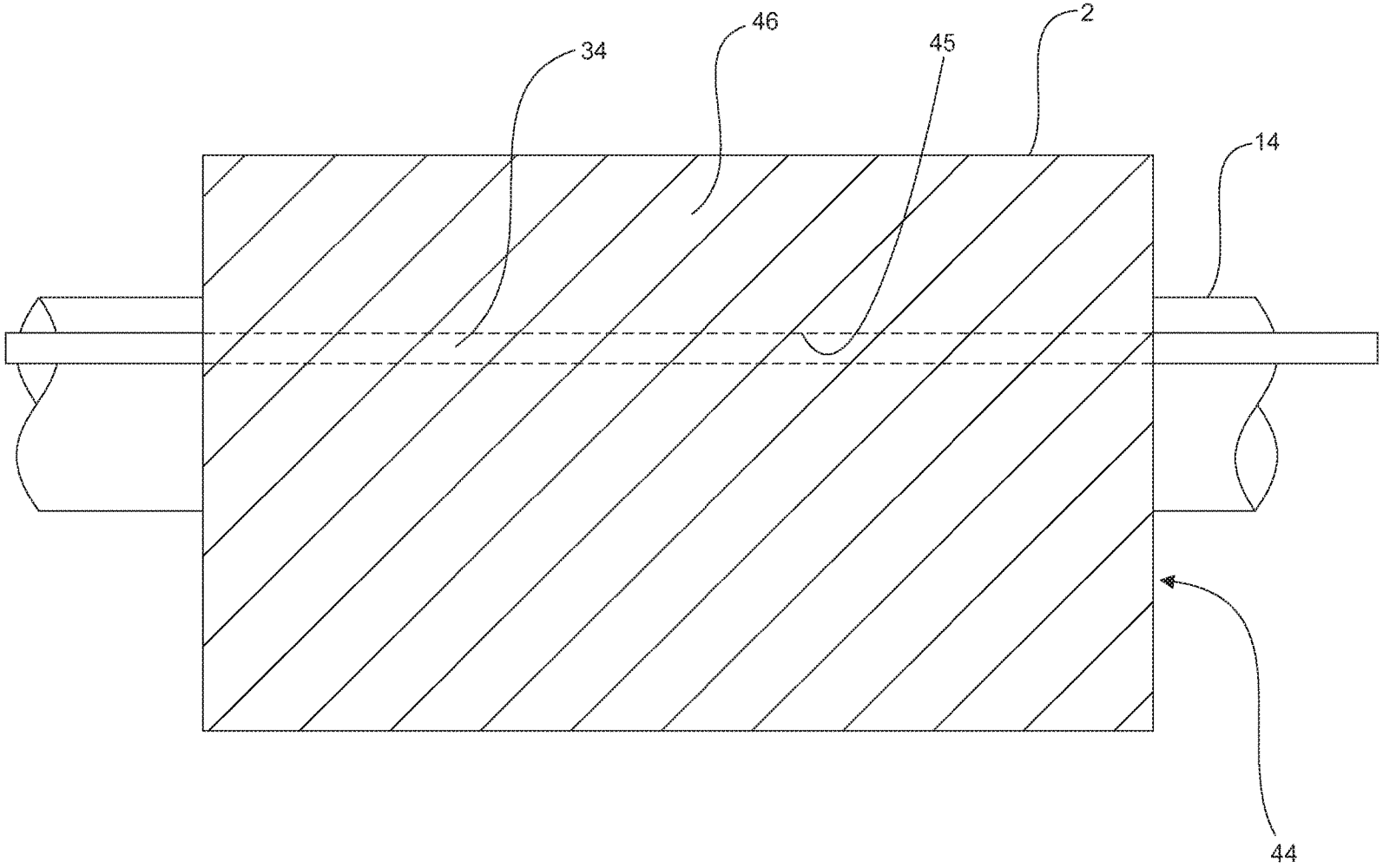
FIG. 11A is a side view of an isolation packer having a wireline installed along an outside of the tubing string therethrough (shown in dotted lines)
Figure 11B:
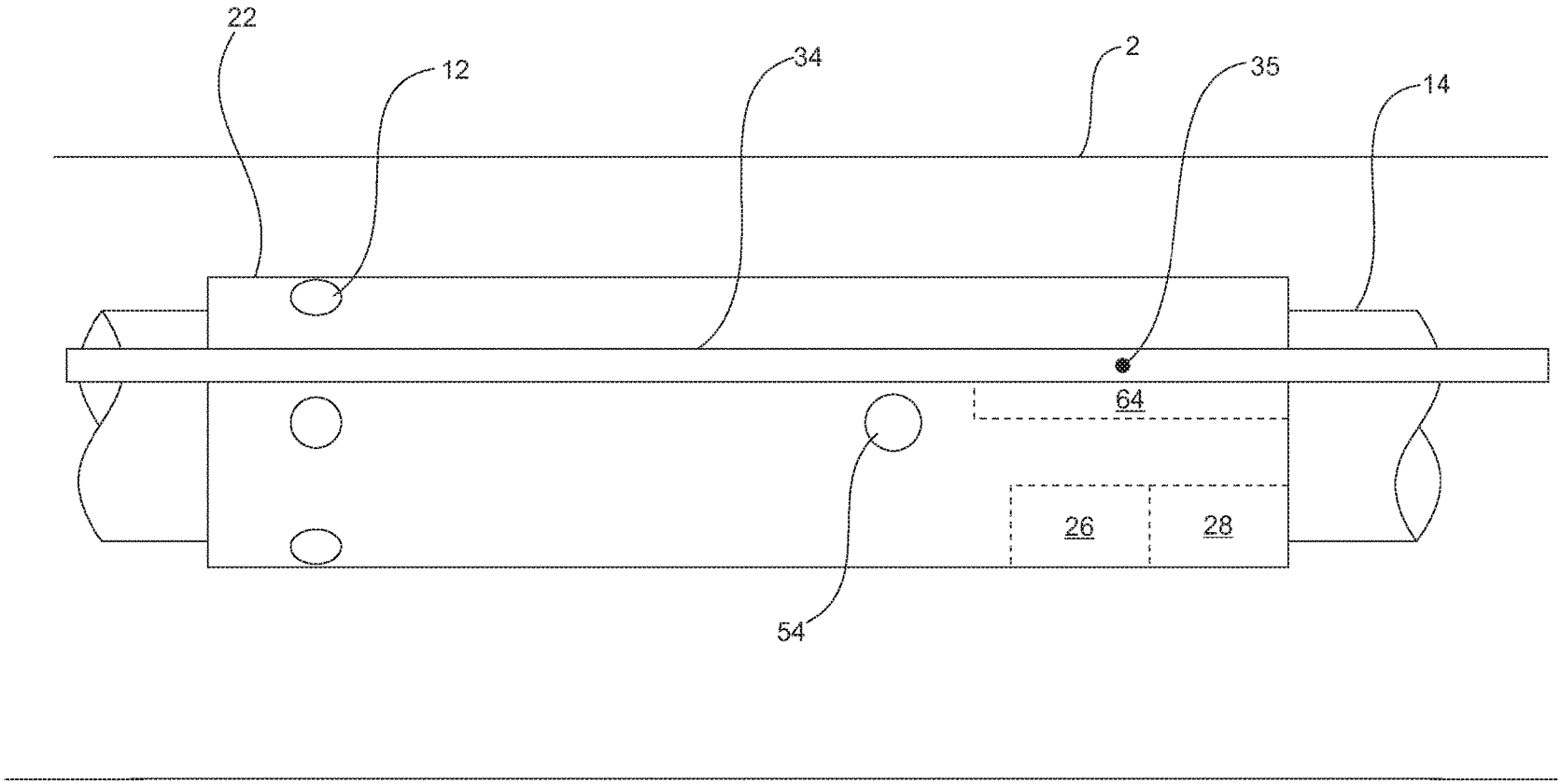
FIG. 11B is a side view of a wireline running along a tubing string and in communication with the resistivity flow monitors and control valves on a sub.

As shown in FIG. 11B, the RFMs 12 and control sleeves 62 can be located on common flow subs 22 while the packers 46 are located on separate packer subs 44. In other embodiments, the RFMs 12, sleeves 62, and isolation packers 46 can all be located on common subs, or are all located on separate subs. The flow subs 22 having the RFMs 12 and control sleeves 62 can be installed along the tubing string 14 such that each RFM 12 and control sleeve 62 will be located adjacent to a corresponding injection zone 4 of the injection well 2 when the tubing string 14 is run into the injector well 2 to a desired depth. Further, the RFMs 12 are each located upstream of respective tubing string ports 54 of the tubing string 14. The packer subs 44 are installed along the tubing string 14 such that each injection zone 4 is straddled by at least two packers 46.

A wireline 34 is connected to a power supply 30 and controller 36 at a surface end and to the flow subs 22 and packer subs 44 along the length of the wireline 34 to provide power to the components and permit data transfer between the controller and the RFMs 12, packer valves 48, and sleeve drive mechanisms 64. The controller 36 receives and processes resistivity data from the RFMs 12 and transmits instructions to the control sleeve drive mechanisms 64 to adjust flow through the injection zones 4 accordingly. The wireline 34 can be secured to the tubing string 14, such as with a plurality of straps or clamps.

In operation, the toe valve 52 is first activated to seal the downhole end of the tubing string 14. The isolation packer valves 48 can then be opened, and the control sleeves 62 actuated to the fully closed position. Fluid 20*a*,20*b* can then be injected into the tubing string bore 16 to pressurize the bore 16 and inflate the isolation packers 46, thereby fluidly isolating the injection zones 4. One the successful setting of the isolation packers 46 is confirmed, the packer valves 48 can be closed to maintain the packers 46 in the set position. The control sleeves 62 can then be actuated to the desired starting position, for example the fully open position, and the first and second fluids 20*a*,20*b*, in this case clean and salt water, are alternatingly injected into the tubing string bore 16. The injected fluid 20*a*,20*b* flows from the bore 16 of the tubing string into the annulus 18 via the tubing string ports 54, and from the annulus 18 into the hydrocarbon formation through the openings of the corresponding injection zone 4. The RFMs 12 detect and log the arrival times of the injected fluids 20*a*,20*b*, which can be used to calculate the fluid flow rates through the various injection zones 4, as described above. The control sleeves 62 can be adjusted in real-time or near real-time by the controller 36 in response to the calculated fluid flow rates in order to produce a more uniform flood front.

Figure 9:
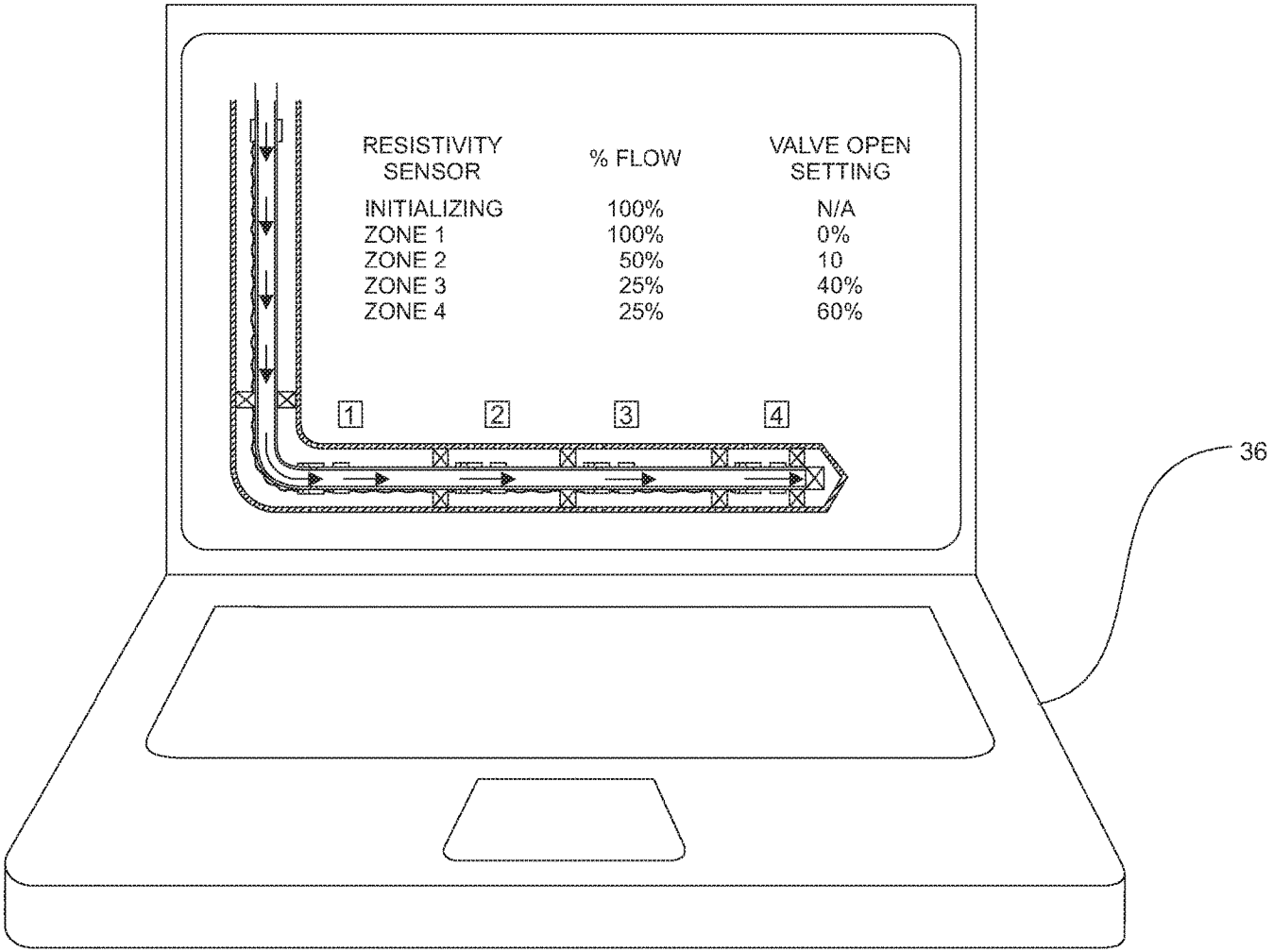
FIG. 9 is a computer display illustrating the status of various fluid control valves in various zones and the fluid flow rates therein in the well of FIGS. 8A to 8C, the flow rates having been calculated using resistivity data.

For example, as shown in FIG. 9, a controller or computer 36 is used to receive and process resistivity data from the RFMs 12 to calculate the percentage flow rate of fluid flowing out to the formation through each injection zone 4. The computer 36 also displays the position of the control sleeves 30 corresponding to each injection zone 4. An operator can use the computer 36 to manually change the position of the control sleeves 62 in response to the calculated flow rates, or a computer program can be used to automatically adjust the position of the sleeves 62.

When fluid injection operations are complete, the packer valves 48 of the isolation packers 46 can be opened to release pressure from and unset the packers. The tubing string 14 can then be retrieved from the injector well 2 and the equipment removed therefrom to be used in a new wellbore.

If desired, initial flow tests to determine the flow characteristics of the injection zones 4 can be run by alternatingly injecting clean water 20*a* and salt water 20*b* into injector well 2 through the tubing string bore 16 and back uphole through the annulus 18, or downhole through the annulus 18. During such initial flow tests, the toe valve 52 is open, the isolation packers 46 are not set, and the control sleeves 62 are closed. Once initial flow tests are complete, the isolation packers 46 can be set and the fluid flow monitoring and flow control process can be carried out as described above.

As discussed previously, a power supply 30 can be located at surface and connected to the RFMs 12, control sleeve drive mechanisms 64, and packer valves 48 via wireline 34. A data storage unit 32 can also be located at surface and connected to the wireline 34 to receive resistivity data from the RFMs 12. The data storage unit 32 can be integral with, or separate from, the controller 36. In embodiments, a portable power source 26, such as a battery, is located in the RFM 12, control sleeve 62, and/or isolation packer 46 subs to power said components either alone or in combination with another power source. In embodiments, an on-board memory module 28 can also be located in the subs for storing the acquired resistivity data, either as a backup to the data sent to the data storage unit at surface, or as stand-alone data storage. Flow data stored on the memory modules 28 of the RFM subs 22 can be analyzed when the tubing string 14 is retrieved from the injector well 2.

Wireline Configuration

In some embodiments, the wireline 34 can terminate on a first side of the flow and packer subs 22,44 at a first connection thereof. An electrical conduit can extend through the subs 22,44 from the first connection to a second connection located at a second side of the sub opposite the first side. In this manner, the subs 22,44 can be electrically connected to each other via discrete sections of wireline 34.

In other embodiments, with reference to FIGS. 11A and 11B, a single continuous length of wireline 34 can be run along the tubing string 14 to electrically connect all of the subs 22,44. Use of a single continuous wireline 34 is desirable, as such a configuration makes assembly of the tubing string 14 and electrical connection of the subs 22,44 more convenient. The continuous length of wireline 34 can be secured to the tubing string 14 with axially spaced clamps, straps, or other suitable securing means.

Pins or similar devices 35 can be used to pierce the wireline 34 to establish electrical connectivity between the wireline and the subs 22,44 or other tubing string components without severing the wireline 34.

For packer subs 44, a track or race 45 can be formed in the packer subs 44 to permit the wireline 34 to run therethrough. Said track 45 can have seals for engaging with the wireline 34 to prevent fluid from bypassing the packer elements 46 when they are deployed.

Example Flow Monitoring System

FIGS. 2B and 2C depict a test of the flow monitoring system 10 described above, RFM subs 22 were installed along a tubing string 14 comprising jointed tubing, which was run into an injector well 2, forming an annulus 18 between the tubing string 14 and the injector well 2. The RFMs 12 of the RFM subs 22 were configured to measure the resistivity of fluid flowing thereby in the annulus 18. Power was supplied to the RFMs 12 via an on-board power-source 26 in the RFM subs 22, and the resistivity data acquired by the RFMs 12 were stored in an on-board memory module 28. An initializing RFM 13 was positioned at the wellhead, and RFM subs 22 having first, second, third, and fourth RFMs 12*a*-12*d* were installed along the tubing string 14 at depths of 1253 m, 1134 m, 997 m, and 831 m, respectively, such that the RFMs 12 were located adjacent to, and upstream of, respective first, second, third, and fourth injection zones 4*a*-4*d*. The annulus 18 was sealed at surface, and clean water 20*a* and salt water 20*b* were alternatingly injected into the tubing string bore 16 over the course of 18 days at a substantially constant rate, and the resistivity of the injected fluids 20*a*,20*b* were measured by the RFMs 12 to detect and log the arrival times of the clean and salt water at each RFM 12.

FIG. 5A is a normalized graph of the resistivity measured by each RFM over 18 days, showing significant increases and drops in resistivity corresponding with the arrival of clean water 20*a* and salt water 20*b* at the RFMs 12. As is evident in the graph, the resistivity measured by the RFMs 12 further downhole can be less than that measured by RFMs 12 closer to surface due to the contamination of the electrodes thereof by hydrocarbons and other substances in the wellbore. Therefore, the injected clean and salt water 20*a*,20*b* should be selected to have sufficiently distinguishable resistivities even when measured by contaminated or corroded RFMs 12. FIG. 5B shows the normalized resistivity data after being time-aligned, which better illustrates that the fluid interface between clean water 20*a* and salt water 20*b* can be easily identified and is relatively consistent across all of the RFMs 12.

As shown in FIG. 5C, the resistivity data for the RFMs 12 can also be cross-correlated in order to facilitate determination of the time clean water 20*a* or salt water 20*b* arrives at a RFM unit 12. As shown, resistivity data of the initializing RFM 13 was cross-correlated with the data from the first, second, and third RFMs 12*a*-12*c*, The peaks of the cross-correlation graph indicate the time at which maximum similarity occurs between the collected data. The timing of the peaks can be used to more easily determine the arrival times of the injected fluid at the RFMs 12. The arrival times of the injected fluid 20*a*,20*b* can be determined either by visual inspection or review of the cross-correlated data, or automatically, for example by using an algorithm that identifies the times at which the maxima of the cross-correlated functions occur.

Figure 6B:
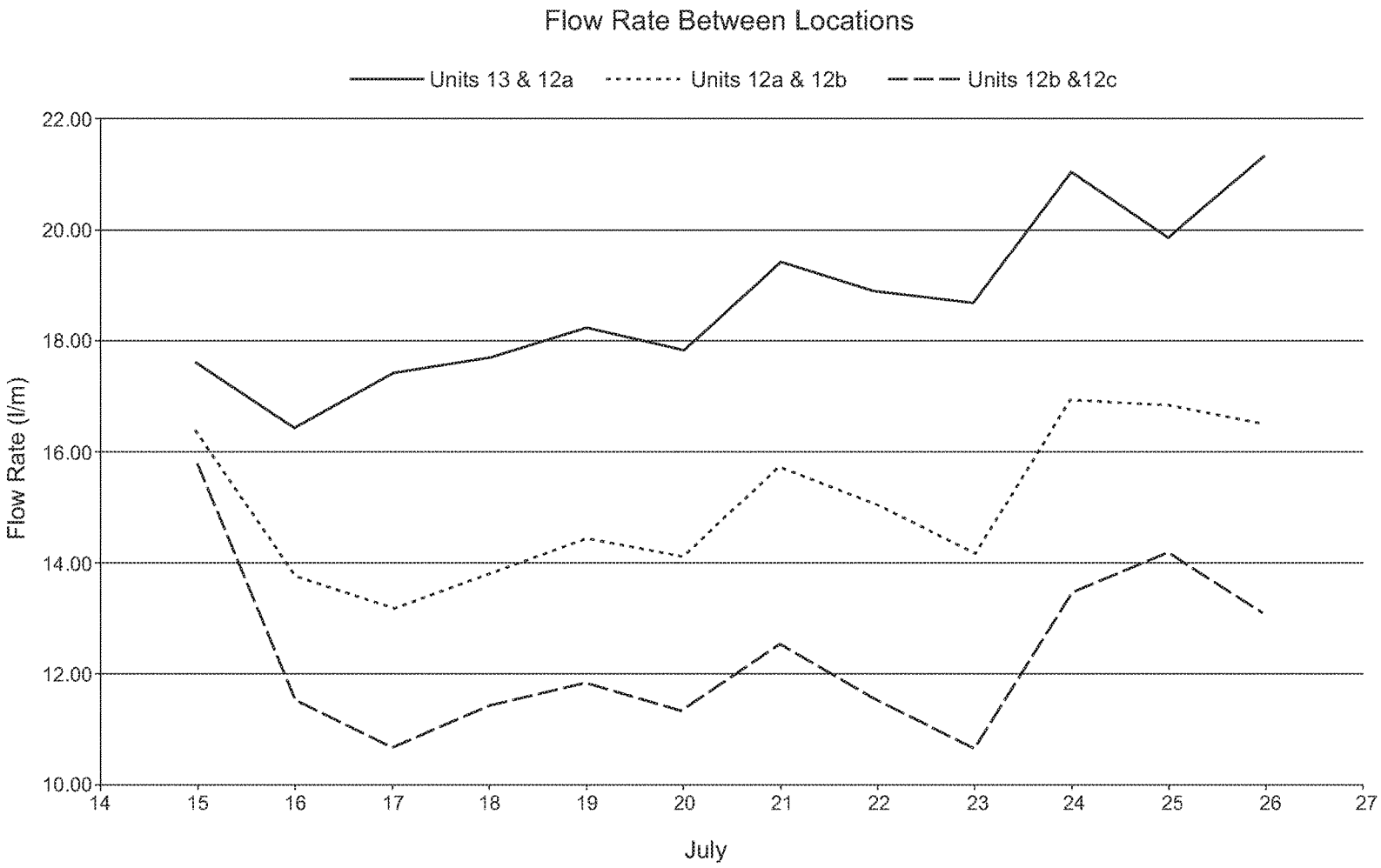
FIG. 6B is a graphical representation of the flow rate of fluid through the various injector zones compared to the total flow rate.
Figure 6C:
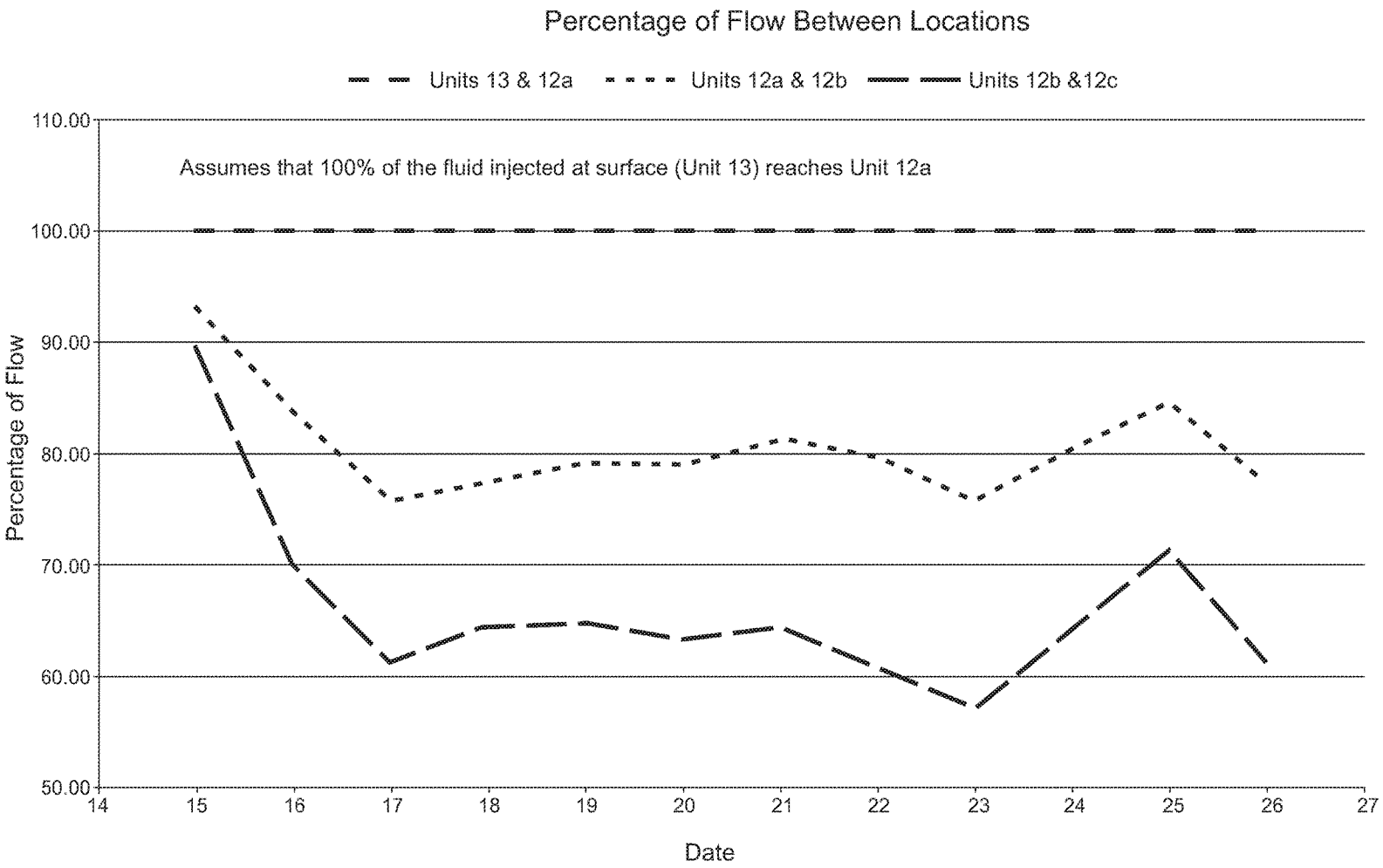
FIG. 6C is a graphical representation of the percentage of the total flow through the various injector zones.

FIG. 6A is a table showing the arrival times of the clean water 20*a* and salt water 20*b* travelling from the initializing RFM 13 to RFM unit 12*a*, and from RFM units 12*a* to 12*b*, 12*b* to 12*c*, and 12*c* to 12*d*. The fluid flow rates from the initializing RFM 13 to the other RFM units 12 were calculated based on the fluid arrival times, and the percentage loss of fluid flow rate between RFM stages was also calculated to determine what percentage of the total injected fluid flow rate exited the injector bore through the various injection zones. FIG. 6B graphically represents the absolute flow rate of injected fluid into the wellbore and into the formation through the injection zones 4, and FIG. 6C graphically represents the percentage of the total flow rate of fluid travelling through each injection zone 4 into the formation.

System Assembly Process

Figure 10:
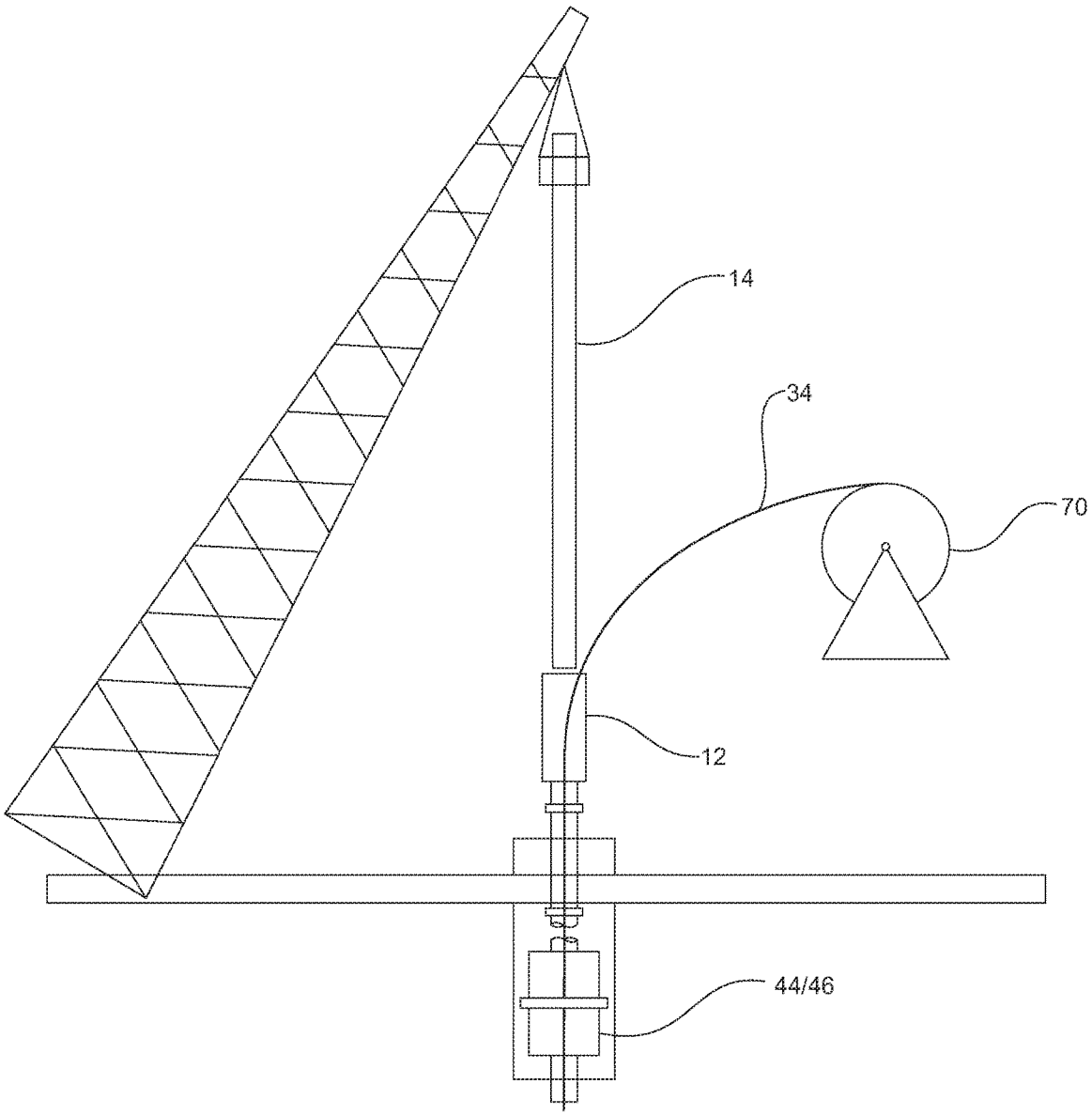
FIG. 10 is a schematic representation of a fluid monitoring and fluid control system according to embodiments disclosed herein installed on a tubing string.

With reference to FIG. 10, the flow monitoring and control system 1060 can be assembled by first assembling the service rig above the injector well 2. The tubing string 14 and tubing string components, such as the flow and packer subs 22,44, can then be assembled. The tubing string components can be added to the tubing string 14 as its being run-in-hole, beginning with the most downhole component. Wireline 34 can be fed from a wireline spool and electrically connect to the components and secured to the tubing string as the tubing string and components are installed. The tubing string components can be tested as they are installed on the tubing string. At the end of the wireline spool 70, a power source 30 with an electrical interface is connected to power the tubing string components and ensure each added tubing string component is functioning properly. Testing the tubing string components as they are installed avoids assembling the entire tubing string 14 only to find a component is malfunctioning, requiring the entire tubing string to be pulled out of the wellbore.

One the tubing string 14 is assembled, the wireline spool 70 can be rigged up. The isolation packers 46 remain deactivated and the toe valve 52 is open, and the tubing string 14 is run-in-hole to the desired depth. If the tubing string 14 is run into a dead well, fluid can be circulated as required, and the wireline 34 can be secured to the tubing string 14, such as with clamps or straps as required. If the tubing string 14 is run into a live well, a snubbing unit and swab can be used.

Once the tubing string 14 has reached the desired depth, the tubing string 14 can be hung in position and the wireline 34 isolated. At surface, the power source 30 and controller 36/wireless communications interface 38 can be connected to the wireline 34. The controller 36 can run a diagnostic routine to verify that all tubing string components are functioning properly.

The pump system 40 and fluid sources 42*a*,42*b* can be connected to the wellhead for injecting the first and second fluids 20*a*,20*b* into the injector well 2.

The fluids 20*a*,20*b* can then be alternatingly injected into the injector well 2 to determine the flow characteristics thereof and how much of the fluid flow is exiting the injection zones 4 of the well.

With the toe packer closed 52, all of the isolation packer valves 48 can be opened. The tubing string bore 16 can be pressured up to inflate all isolation packers 46. The successful setting of the packers 46 can be electronically verified, and the isolation packer valves 48 closed such that the packers 46 remain set. The injection zones 4 are now isolated from each other Tubing bore pressure 16 can then be bled off and the flow control devices 62 of the tubing string 14 can be opened. The degree that the flow control devices 62 corresponding to each injection zone 4 are opened can be selected based on the results of the flow test.

After a requisite amount of time has elapsed, for example one week, the first and second fluids 20*a*,20*b* can again be alternatingly pumped into the injector well 2 and the flow rates through the injection zones 4 can be calculated to determine where the flow is going. Such flow monitoring can take place at certain time intervals, for example weekly, to ensure that the fluid flow is substantially even for all injection zones 4, and the flow control devices 62 can be adjusted.

Alternatively, fluid can be injected down the annulus 18 if the isolation packers are not set.

We claim:

1. A method of monitoring and adjusting fluid flow from a wellbore out of a plurality of injection zones of the wellbore, comprising:

alternatingly injecting at least a first fluid and a second fluid into the wellbore at an injection flow rate, the first fluid having a first value of a measurable property and the second fluid having a second value of the measurable property different from the first value;

monitoring the measurable property at an initialization location and a plurality of monitoring locations;

recording an initialization time at which the measurable property changes from about the first value to about the second value, or from about the second value to about the first value, at the initialization location;

recording an arrival time at which the measurable property changes from about the first value to about the second value, or from about the second value to about the first value, at each of the monitoring locations; and determining a flow rate of fluid out of one or more of the plurality of injection zones.

2. The method of claim 1, wherein the step of determining the flow rate of fluid comprises calculating the flow rate of fluid using a cross-sectional area of a flow conduit through which the first and second fluids flow, the initialization time, the arrival times, distances from the initialization location to the monitoring locations, and the injection flow rate.

3. The method of claim 1, further comprising actuating one or more flow control devices each corresponding to a respective one of the plurality of injection zones in response to the determined flow rate of fluid out of one or more of the plurality of injection zones.

4. The method of claim 1, wherein the steps of monitoring the measurable property, recording the initialization time, recording the arrival times, and determining the flow rate are performed substantially in real-time.

5. The method of claim 3, wherein the steps of monitoring the measurable property, recording the initialization time, recording the arrival times, determining the flow rate, and actuating the one or more flow control devices are performed substantially in real-time.

6. The method of claim 1, wherein the first and second fluids are injected into the wellbore via a tubing string extending into the wellbore.

7. The method of claim 1, wherein the first and second fluids are injected into the wellbore via an annulus formed between a tubing string extending into the wellbore and the casing.

8. The method of claim 1, further comprising fluidly isolating each of the injection zones.

9. The method of claim 8, wherein isolating each of the injection zones comprises deploying a plurality of packers in an annulus formed between the tubing string and the casing.

10. A method of monitoring and adjusting fluid flow from a wellbore out of a plurality of injection zones of the wellbore, comprising:

installing a plurality of sensors on a tubing string, each of the plurality of sensors configured to monitor a measurable property of at least a first fluid and a second fluid;

installing an initializing sensor on the tubing string, the initializing sensor configured to monitor the measurable property upstream of the plurality of sensors; and inserting the tubing string into the wellbore to position the plurality of sensors adjacent to a corresponding one of the plurality of injection zones.

11. The method of claim 10, wherein the step of inserting the tubing string into the wellbore comprises positioning the plurality of sensors such that each of the plurality of sensors is located upstream of a corresponding one of the plurality of injection zones.

12. The method of claim 10, wherein the step of inserting the tubing string into the wellbore comprises positioning the plurality of sensors such that each sensor of the plurality of sensors is located upstream of a respective injection zone of the plurality of injection zones.

13. The method of claim 10, further comprising installing a plurality of packers on the tubing string, and wherein the step of inserting the tubing string into the wellbore further comprises positioning the plurality of packers such that each of the plurality of injection zones is straddled by two packers of the plurality of packers.

14. The method of claim 10, further comprising installing a plurality of flow control devices on the tubing string, and the step of inserting the tubing string into the wellbore further comprises positioning the plurality of flow control devices such that each of the plurality of flow control devices is located adjacent a corresponding one of the plurality of injection zones.

15. A system for monitoring and adjusting fluid flow from a wellbore out of a plurality of injection zones of the wellbore, comprising:

a fluid pump configured to alternatingly pump a first fluid and a second fluid into the wellbore at a flow rate;

a plurality of sensors spaced along a tubing string, each of the plurality of sensors located adjacent to a corresponding one of the plurality of injection zones and configured to monitor a measurable property of at least the first fluid and the second fluid; and an initializing sensor positioned upstream of the plurality of sensors;

wherein the first fluid has a first value of the measurable property and the second fluid has a second value of the measurable property different from the first value;

wherein distances between each sensor of the plurality of sensors are known; and wherein at least a distance between the initializing sensor and a sensor of the plurality of sensors immediately downstream of the initializing sensor is known.

16. The system of claim 15, wherein each of the plurality of sensors is located immediately uphole of the corresponding one of the plurality of injection zones.

17. The system of claim 15, further comprising a plurality of packers positioned along the tubing string such each of the plurality of injection zones is straddled by two packers of the plurality of packers.

18. The system of claim 17, wherein the plurality of packers is operatively connected to a controller at surface via a wireline.

19. The system of claim 15, further comprising a plurality of flow control devices positioned along the tubing string and located adjacent a corresponding one of the plurality of injection zones, each of the flow control devices being actuable between at least a fully open position and a fully closed position.

* * * * *